US008106836B2

(12) United States Patent
Hill et al.

(10) Patent No.: US 8,106,836 B2
(45) Date of Patent: Jan. 31, 2012

(54) HYBRID ANTENNAS FOR ELECTRONIC DEVICES

(75) Inventors: Robert J. Hill, Salinas, CA (US); Scott A. Myers, San Francisco, CA (US); Robert W. Schlub, Campbell, CA (US); Dean Floyd Darnell, Santa Clara, CA (US); Zhijun Zhang, Beijing (CN)

(73) Assignee: Apple Inc., Cupertino, CA (US)

( * ) Notice: Subject to any disclaimer, the term of this patent is extended or adjusted under 35 U.S.C. 154(b) by 690 days.

(21) Appl. No.: 12/120,012

(22) Filed: May 13, 2008

(65) Prior Publication Data

US 2009/0256759 A1 Oct. 15, 2009

Related U.S. Application Data

(60) Provisional application No. 61/044,448, filed on Apr. 11, 2008.

(51) Int. Cl.
*H01Q 1/24* (2006.01)

(52) U.S. Cl. ..... 343/702; 343/700 MS; 343/797

(58) Field of Classification Search ..... 343/702, 343/872, 700 MS, 797
See application file for complete search history.

(56) References Cited

U.S. PATENT DOCUMENTS

| | | | |
|---|---|---|---|
| 2,947,987 | A | 8/1960 | Dodington |
| 4,641,366 | A | 2/1987 | Yokoyama et al. |
| 4,894,663 | A | 1/1990 | Urbish et al. |
| 4,980,694 | A | 12/1990 | Hines |
| 4,987,421 | A | 1/1991 | Sunahara et al. |
| 5,021,010 | A | 6/1991 | Wright |
| 5,041,838 | A | 8/1991 | Liimatainen et al. |
| 5,048,118 | A | 9/1991 | Brooks et al. |
| 5,561,437 | A | 10/1996 | Phillips et al. |
| 5,754,143 | A | 5/1998 | Warnagiris et al. |
| 5,798,984 | A | 8/1998 | Koch |
| 6,011,699 | A | 1/2000 | Murray et al. |
| 6,097,345 | A | 8/2000 | Walton |

(Continued)

FOREIGN PATENT DOCUMENTS

| | | |
|---|---|---|
| CN | 2733831 | 10/2005 |

(Continued)

OTHER PUBLICATIONS

Hill et al. U.S. Appl. No. 11/821,192, filed Jun. 21, 2007.

(Continued)

*Primary Examiner* — Dieu H Duong
(74) *Attorney, Agent, or Firm* — Treyz Law Group; G. Victor Treyz; David C. Kellogg

(57) ABSTRACT

A portable electronic device is provided that has a hybrid antenna. The hybrid antenna may include a slot antenna structure and an inverted-F antenna structure. The slot antenna portion of the hybrid antenna may be used to provide antenna coverage in a first communications band and the inverted-F antenna portion of the hybrid antenna may be used to provide antenna coverage in a second communications band. The second communications band need not be harmonically related to the first communications band. The electronic device may be formed from two portions. One portion may contain conductive structures that define the shape of the antenna slot. One or more dielectric-filled gaps in the slot may be bridged using conductive structures on another portion of the electronic device. A conductive trim member may be inserted into an antenna slot to trim the resonant frequency of the slot antenna portion of the hybrid antenna.

28 Claims, 22 Drawing Sheets

U.S. PATENT DOCUMENTS

| | | | |
|---|---|---|---|
| 6,140,966 | A | 10/2000 | Pankinaho |
| 6,184,845 | B1 | 2/2001 | Leisten et al. |
| 6,191,740 | B1 | 2/2001 | Kates et al. |
| 6,266,538 | B1 | 7/2001 | Waldron |
| 6,337,662 | B1 | 1/2002 | Cassel |
| 6,339,400 | B1 | 1/2002 | Flint et al. |
| 6,346,914 | B1 | 2/2002 | Annamaa |
| 6,348,894 | B1 | 2/2002 | Lahti |
| 6,384,696 | B1 | 5/2002 | Miller et al. |
| 6,404,394 | B1 | 6/2002 | Hill |
| 6,424,300 | B1 | 7/2002 | Sanford |
| 6,573,869 | B2 | 6/2003 | Moore |
| 6,622,031 | B1 | 9/2003 | McCleary et al. |
| 6,624,789 | B1 | 9/2003 | Kangasvieri et al. |
| 6,670,923 | B1 | 12/2003 | Kadambi et al. |
| 6,741,214 | B1 | 5/2004 | Kadambi et al. |
| 6,747,601 | B2 | 6/2004 | Boyle |
| 6,831,607 | B2 | 12/2004 | Hebron et al. |
| 6,856,294 | B2 | 2/2005 | Kadambi et al. |
| 6,882,317 | B2 | 4/2005 | Koskiniemi et al. |
| 6,968,508 | B2 | 11/2005 | Lucaci et al. |
| 6,980,154 | B2 | 12/2005 | Vance et al. |
| 7,027,838 | B2 | 4/2006 | Zhou et al. |
| 7,053,841 | B2 | 5/2006 | Ponce De Leon et al. |
| 7,053,852 | B2 | 5/2006 | Timofeev et al. |
| 7,116,276 | B2 | 10/2006 | Lee |
| 7,119,747 | B2 | 10/2006 | Lin et al. |
| 7,123,208 | B2 | 10/2006 | Baliarda et al. |
| 7,202,826 | B2 | 4/2007 | Grant et al. |
| 7,289,068 | B2 | 10/2007 | Fujio et al. |
| 7,403,164 | B2 | 7/2008 | Sanz et al. |
| 7,443,810 | B2 | 10/2008 | Boyle |
| 7,535,422 | B2 | 5/2009 | Liu et al. |
| 7,595,759 | B2 | 9/2009 | Schlub et al. |
| 7,612,725 | B2 | 11/2009 | Hill et al. |
| 7,768,462 | B2 | 8/2010 | Zhang et al. |
| 7,808,438 | B2 | 10/2010 | Schlub et al. |
| 7,864,123 | B2 | 1/2011 | Hill et al. |
| 7,893,883 | B2 | 2/2011 | Schlub et al. |
| 7,898,485 | B2 | 3/2011 | Schlub et al. |
| 7,911,387 | B2 | 3/2011 | Hill et al. |
| 2001/0052877 | A1 | 12/2001 | Honda et al. |
| 2003/0074780 | A1 | 4/2003 | Doran et al. |
| 2003/0107518 | A1 | 6/2003 | Li et al. |
| 2003/0119457 | A1 | 6/2003 | Standke |
| 2004/0017318 | A1 | 1/2004 | Annabi et al. |
| 2004/0058723 | A1 | 3/2004 | Mikkola et al. |
| 2004/0137950 | A1 | 7/2004 | Bolin et al. |
| 2004/0145521 | A1 | 7/2004 | Hebron et al. |
| 2006/0038736 | A1 | 2/2006 | Hui et al. |
| 2006/0055606 | A1 | 3/2006 | Boyle |
| 2006/0192714 | A1 | 8/2006 | Koyama et al. |
| 2007/0015554 | A1 | 1/2007 | Siddiqui et al. |
| 2007/0018895 | A1 | 1/2007 | Bolin |
| 2007/0030200 | A1 | 2/2007 | Heng et al. |
| 2008/0013011 | A1* | 1/2008 | Hiratsuka et al. ..... 349/59 |
| 2008/0165065 | A1 | 7/2008 | Hill et al. |
| 2008/0231521 | A1 | 9/2008 | Anguera Pros et al. |
| 2009/0040115 | A1 | 2/2009 | Zhang et al. |
| 2009/0256759 | A1 | 10/2009 | Hill et al. |
| 2009/0303139 | A1 | 12/2009 | Schlub et al. |
| 2010/0007564 | A1 | 1/2010 | Hill et al. |

FOREIGN PATENT DOCUMENTS

| | | |
|---|---|---|
| CN | 1692565 | 11/2005 |
| CN | 1770654 | 5/2006 |
| CN | 101098046 | 1/2008 |
| EP | 0 851 530 | 7/1998 |
| EP | 1 315 238 | 7/2003 |
| EP | 1 351 334 | 10/2003 |
| EP | 1 401 050 | 3/2004 |
| EP | 1895617 | 3/2008 |
| GB | 2 301 485 | 12/1996 |
| JP | 09-093031 | 4/1997 |
| JP | 2002-538648 | 8/2000 |
| JP | 2003-124730 | 4/2003 |
| JP | 2006-109456 | 4/2006 |
| WO | 00-51201 | 8/2000 |
| WO | 02/078123 | 10/2002 |
| WO | 2006/114771 | 10/2002 |
| WO | 2004/001894 | 12/2003 |
| WO | 2004/038857 | 5/2004 |
| WO | 2004/102744 | 11/2004 |
| WO | 2005/109567 | 11/2005 |
| WO | 2006/070017 | 7/2006 |
| WO | 2006/097496 | 9/2006 |

OTHER PUBLICATIONS

Hill et al. U.S. Appl. No. 11/821,363, filed Jun. 21, 2007.
Hobson et al. U.S. Appl. No. 60/883,587, filed Jan. 5, 2007.
Hill et al. U.S. Appl. No. 11/897,033, filed Aug. 28, 2007.
Schlub et al. U.S. Appl. No. 11/650,071, filed Jan. 4, 2007.
Schlub et al. U.S. Appl. No. 11/650,187, filed Jan. 4, 2007.
Zhang et al. U.S. Appl. No. 11/895,053, filed Aug. 22, 2007.
Zhang et al. U.S. Appl. No. 11/890,865, filed Aug. 7, 2007.
Schlub et al. U.S. Appl. No. 13/092,875, filed Apr. 22, 2011.

* cited by examiner

HYBRID ANTENNAS FOR ELECTRONIC DEVICES

This application claims the benefit of provisional patent application No. 61/044,448, filed Apr. 11, 2008, which is hereby incorporated by reference herein in its entirety.

BACKGROUND

This invention relates generally to electronic devices, and more particularly, to antennas for electronic devices such as portable electronic devices.

Handheld electronic devices and other portable electronic devices are becoming increasingly popular. Examples of handheld devices include handheld computers, cellular telephones, media players, and hybrid devices that include the functionality of multiple devices of this type. Popular portable electronic devices that are somewhat larger than traditional handheld electronic devices include laptop computers and tablet computers.

Due in part to their mobile nature, portable electronic devices are often provided with wireless communications capabilities. For example, handheld electronic devices may use long-range wireless communications to communicate with wireless base stations. Cellular telephones and other devices with cellular capabilities may communicate using cellular telephone bands at 850 MHz, 900 MHz, 1800 MHz, and 1900 MHz. Portable electronic devices may also use short-range wireless communications links. For example, portable electronic devices may communicate using the Wi-Fi® (IEEE 802.11) bands at 2.4 GHz and 5.0 GHz and the Bluetooth® band at 2.4 GHz. Data communications are also possible at 2100 MHz.

To satisfy consumer demand for small form factor wireless devices, manufacturers are continually striving to reduce the size of components that are used in these devices while providing enhanced functionality. Significant enhancements may be difficult to implement, however, particularly in devices in which size and weight are taken into consideration. For example, it can be particularly challenging to form antennas that operate in desired communications bands while fitting the antennas within the case of a compact portable electronic device.

It would therefore be desirable to be able to provide portable electronic devices with improved wireless communications capabilities.

SUMMARY

A portable electronic device such as a handheld electronic device is provided. The handheld electronic device may include a hybrid antenna. The hybrid antenna may include a slot antenna structure and an inverted-F antenna structure. The slot antenna portion of the hybrid antenna may be used to provide antenna coverage in a first communications band and the inverted-F antenna portion of the hybrid antenna may be used to provide antenna coverage in a second communications band. The second communications band need not be harmonically related to the first communications band. With one suitable arrangement, the first communications band handles 1575 MHz signals (e.g., for global positioning system operations) and the second communications band handles 2.4 GHz signals (e.g., for local area network or Bluetooth® operations).

The handheld electronic device may be formed from two portions. A first portion may include components such as a display and a touch sensor. A second portion may include components such as a camera, printed circuit boards, a battery, flex circuits, a Subscriber Identity Module card structure, an audio jack, and a conductive bezel. The components in the second portion may define an antenna slot for the slot antenna structure in the hybrid antenna. Dielectric-filled gaps may be located between some of the components in the antenna slot formed in the second portion of the device. These gaps in the antenna slot may be bridged using conductive structures associated with the first portion of the device. With one suitable arrangement, springs or other connecting structures may be attached to the second portion of the device on either side of each gap. A matching conductive bracket may be mounted on the first portion of the device. When the first and second portions are assembled, the springs form a conductive path that allows radio-frequency signals to pass through the bracket. In this way, the bracket can bridge the gaps to complete the antenna slot (e.g., to form a substantially rectangular antenna slot).

If desired, a conductive trim member may be inserted into an antenna slot to adjust the resonant frequency of the slot antenna portion of the hybrid antenna.

Further features of the invention, its nature and various advantages will be more apparent from the accompanying drawings and the following detailed description of the preferred embodiments.

DETAILED DESCRIPTION

The present invention relates generally to electronic devices, and more particularly, to portable electronic devices such as handheld electronic devices.

The electronic devices may be portable electronic devices such as laptop computers or small portable computers of the type that are sometimes referred to as ultraportables. Portable electronic devices may also be somewhat smaller devices. Examples of smaller portable electronic devices include wrist-watch devices, pendant devices, headphone and earpiece devices, and other wearable and miniature devices. With one suitable arrangement, the portable electronic devices may be wireless electronic devices.

The wireless electronic devices may be, for example, handheld wireless devices such as cellular telephones, media players with wireless communications capabilities, handheld computers (also sometimes called personal digital assistants), remote controllers, global positioning system (GPS) devices, and handheld gaming devices. The wireless electronic devices may also be hybrid devices that combine the functionality of multiple conventional devices. Examples of hybrid portable electronic devices include a cellular telephone that includes media player functionality, a gaming device that includes a wireless communications capability, a cellular telephone that includes game and email functions, and a portable device that receives email, supports mobile telephone calls, has music player functionality and supports web browsing. These are merely illustrative examples.

Figure 1:
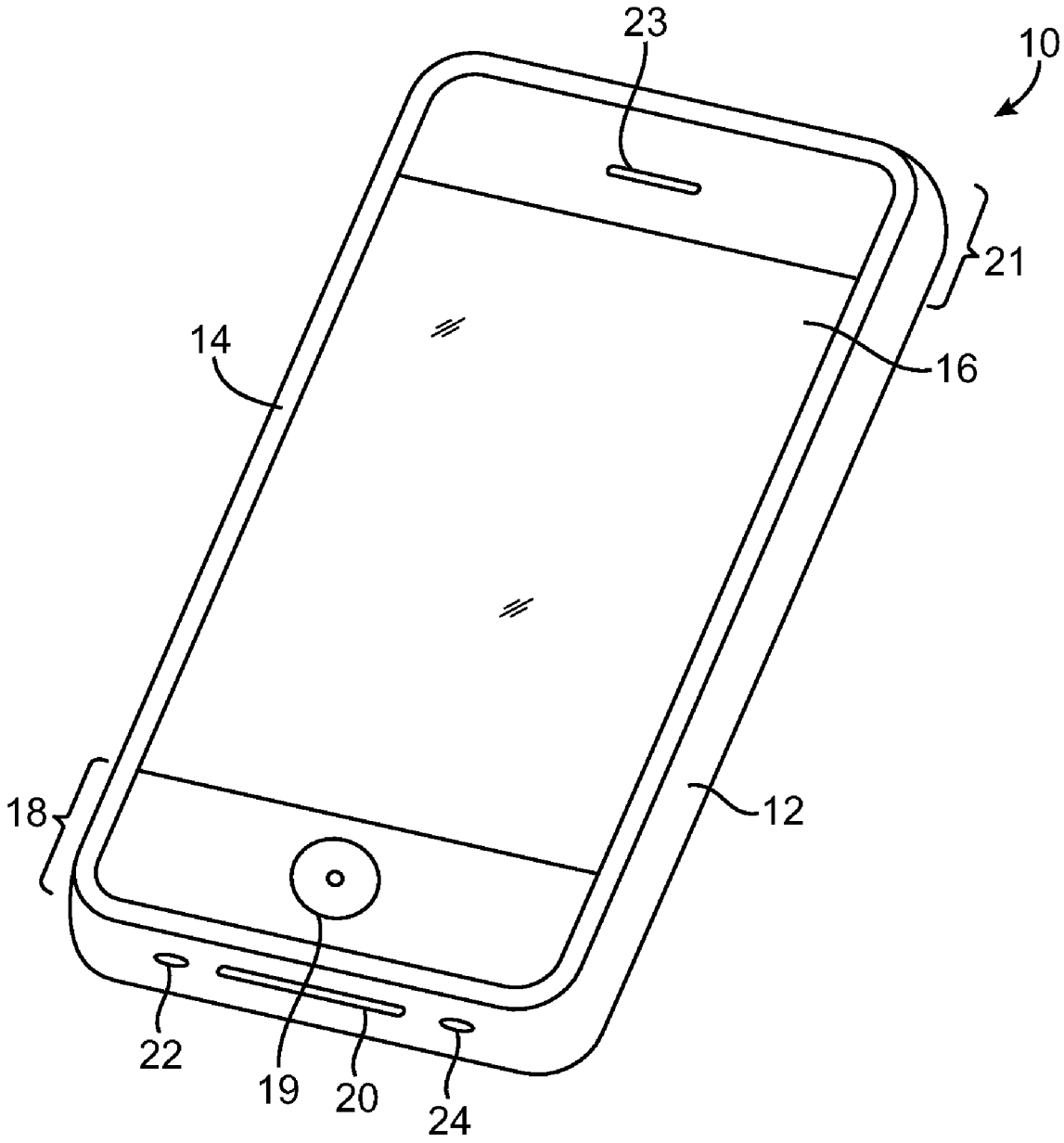
FIG. 1 is a perspective view of an illustrative portable electronic device in accordance with an embodiment of the present invention.

An illustrative portable electronic device in accordance with an embodiment of the present invention is shown in FIG. 1. Device 10 of FIG. 1 may be, for example, a handheld electronic device that supports 2G and/or 3G cellular telephone and data functions, global positioning system capabilities, and local wireless communications capabilities (e.g., IEEE 802.11 and Bluetooth®) and that supports handheld computing device functions such as internet browsing, email and calendar functions, games, music player functionality, etc.

Device 10 may have housing 12. Antennas for handling wireless communications may be housed within housing 12 (as an example).

Housing 12, which is sometimes referred to as a case, may be formed of any suitable materials including, plastic, glass, ceramics, metal, or other suitable materials, or a combination of these materials. In some situations, housing 12 or portions of housing 12 may be formed from a dielectric or other low-conductivity material, so that the operation of conductive antenna elements that are located in proximity to housing 12 is not disrupted. Housing 12 or portions of housing 12 may also be formed from conductive materials such as metal. An advantage of forming housing 12 from a dielectric material such as plastic is that this may help to reduce the overall weight of device 10 and may avoid potential interference with wireless operations.

In scenarios in which housing 12 is formed from metal elements, one or more of the metal elements may be used as part of the antennas in device 10. For example, metal portions of housing 12 may be shorted to an internal ground plane in device 10 to create a larger ground plane element for that device 10.

Housing 12 may have a bezel 14. The bezel 14 may be formed from a conductive material or other suitable material or other suitable material. Bezel 14 may serve to hold a display or other device with a planar surface in place on device 10. Bezel 14 may also form an esthetically pleasing trim around the edge of device 10. As shown in FIG. 1, for example, bezel 14 may be used to surround the top of display 16. Bezel 14 and other metal elements associated with device 10 may be used as part of the antennas in device 10. For example, bezel 14 may be shorted to printed circuit board conductors or other internal ground plane structures in device 10 to create a larger ground plane element for device 10.

Display 16 may be a liquid crystal display (LCD), an organic light emitting diode (OLED) display, or any other suitable display. The outermost surface of display 16 may be formed from one or more plastic or glass layers. If desired, touch screen functionality may be integrated into display 16 or may be provided using a separate touch pad device. An advantage of integrating a touch screen into display 16 to make display 16 touch sensitive is that this type of arrangement can save space and reduce visual clutter.

Display screen 16 (e.g., a touch screen) is merely one example of an input-output device that may be used with electronic device 10. If desired, electronic device 10 may have other input-output devices. For example, electronic device 10 may have user input control devices such as button 19, and input-output components such as port 20 and one or more input-output jacks (e.g., for audio and/or video). Button 19 may be, for example, a menu button. Port 20 may contain a 30-pin data connector (as an example). Openings 22 and 24 may, if desired, form speaker and microphone ports. Speaker port 22 may be used when operating device 10 in speakerphone mode. Opening 23 may also form a speaker port. For example, speaker port 23 may serve as a telephone receiver that is placed adjacent to a user's ear during operation. In the example of FIG. 1, display screen 16 is shown as being mounted on the front face of handheld electronic device 10, but display screen 16 may, if desired, be mounted on the rear face of handheld electronic device 10, on a side of device 10, on a flip-up portion of device 10 that is attached to a main body portion of device 10 by a hinge (for example), or using any other suitable mounting arrangement.

A user of electronic device 10 may supply input commands using user input interface devices such as button 19 and touch screen 16. Suitable user input interface devices for electronic device 10 include buttons (e.g., alphanumeric keys, power on-off, power-on, power-off, and other specialized buttons, etc.), a touch pad, pointing stick, or other cursor control device, a microphone for supplying voice commands, or any other suitable interface for controlling device 10. Although shown schematically as being formed on the top face of electronic device 10 in the example of FIG. 1, buttons such as button 19 and other user input interface devices may generally be formed on any suitable portion of electronic device 10. For example, a button such as button 19 or other user interface control may be formed on the side of electronic device 10. Buttons and other user interface controls can also be located on the top face, rear face, or other portion of device 10. If desired, device 10 can be controlled remotely (e.g., using an infrared remote control, a radio-frequency remote control such as a Bluetooth® remote control, etc.).

Electronic device 10 may have ports such as port 20. Port 20, which may sometimes be referred to as a dock connector, 30-pin data port connector, input-output port, or bus connector, may be used as an input-output port (e.g., when connecting device 10 to a mating dock connected to a computer or other electronic device). Port 20 may contain pins for receiving data and power signals. Device 10 may also have audio and video jacks that allow device 10 to interface with external components. Typical ports include power pins to recharge a battery within device 10 or to operate device 10 from a direct current (DC) power supply, data pins to exchange data with external components such as a personal computer or peripheral, audio-visual jacks to drive headphones, a monitor, or other external audio-video equipment, a Subscriber Identity Module (SIM) card port to authorize cellular telephone service, a memory card slot, etc. The functions of some or all of these devices and the internal circuitry of electronic device 10 can be controlled using input interface devices such as touch screen display 16.

Components such as display 16 and other user input interface devices may cover most of the available surface area on the front face of device 10 (as shown in the example of FIG. 1) or may occupy only a small portion of the front face of device 10. Because electronic components such as display 16 often contain large amounts of metal (e.g., as radio-frequency shielding), the location of these components relative to the antenna elements in device 10 should generally be taken into consideration. Suitably chosen locations for the antenna elements and electronic components of the device will allow the antennas of electronic device 10 to function properly without being disrupted by the electronic components.

Examples of locations in which antenna structures may be located in device 10 include region 18 and region 21. These are merely illustrative examples. Any suitable portion of device 10 may be used to house antenna structures for device 10 if desired.

Any suitable antenna structures may be used in device 10. For example, device 10 may have one antenna or may have multiple antennas. The antennas in device 10 may each be used to cover a single communications band or each antenna may cover multiple communications bands. If desired, one or more antennas may cover a single band while one or more additional antennas are each used to cover multiple bands. As an example, a pentaband cellular telephone antenna may be provided at one end of device 10 (e.g., in region 18) and a dual band GPS/Bluetooth®/IEEE-802.11 antenna may be provided at another end of device 10 (e.g., in region 21). These are merely illustrative arrangements. Any suitable antenna structures may be used in device 10 if desired.

In arrangements in which antennas are needed to support communications at more than one band, the antennas may have shapes that support multi-band operations. For example, an antenna may have a resonating element with arms of various different lengths. Each arm may support a resonance at a different radio-frequency band (or bands). The antennas may be based on slot antenna structures in which an opening is formed in a ground plane. The ground plane may be formed, for example, by conductive components such as a display, printed circuit board conductors, flex circuits that contain conductive traces (e.g., to connect a camera or other device to integrated circuits and other circuitry in device 10), a conductive bezel, etc. A slot antenna opening may be formed by arranging ground plane components such as these so as to form a dielectric-filled (e.g., an air-filled) space. A conductive trace (e.g., a conductive trace with one or more bends) or a single-arm or multiarm planar inverted-F antenna may be used in combination with an antenna slot to provide a hybrid antenna with enhanced frequency coverage. Inverted-F antenna elements or other antenna structures may also be used in the presence of an antenna slot to form a hybrid slot/non-slot antenna.

When a hybrid antenna structure is formed that has an antenna slot and a non-slot antenna resonating element, the slot may, if desired, contribute a frequency response for the antenna in a one frequency range, whereas the non-slot structure may contribute to a frequency response for the antenna in another frequency range. Structures such as these may be fed using direct coupling (i.e., when antenna feed terminals are connected to conductive portions of the antenna) or using indirect coupling (i.e., where the antenna is excited through near-field coupling interactions).

Hybrid slot antennas may be used at one end or both ends of device 10. For example, one hybrid antenna may be used as a dual band antenna (e.g., in region 21) and one hybrid antenna may be used as a pentaband antenna (e.g., in region 18). The pentaband antenna may be used to cover wireless communications bands such as the wireless bands at 850 MHz, 900 MHz, 1800 MHz, 1900 MHz, and 2100 MHz (as an example). The dual band antenna may be used to handle 1575 MHz signals for GPS operations and 2.4 GHz signals for Bluetooth® and IEEE 802.11 operations (as an example).

Figure 2:
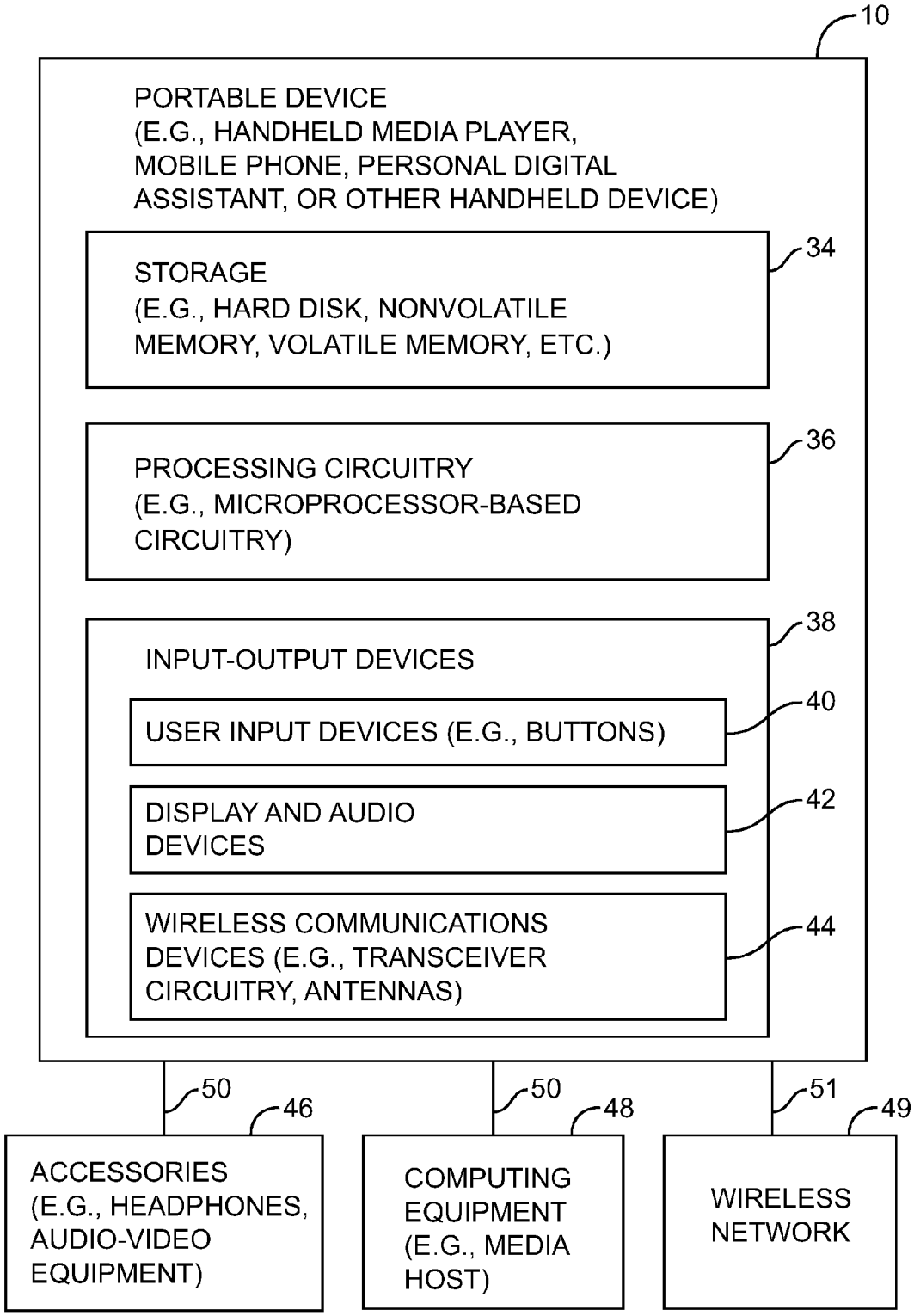
FIG. 2 is a schematic diagram of an illustrative portable electronic device in accordance with an embodiment of the present invention.

A schematic diagram of an embodiment of an illustrative portable electronic device such as a handheld electronic device is shown in FIG. 2. Portable device 10 may be a mobile telephone, a mobile telephone with media player capabilities, a handheld computer, a remote control, a game player, a global positioning system (GPS) device, a laptop computer, a tablet computer, an ultraportable computer, a hybrid device that includes the functionality of some or all of these devices, or any other suitable portable electronic device.

As shown in FIG. 2, device 10 may include storage 34. Storage 34 may include one or more different types of storage such as hard disk drive storage, nonvolatile memory (e.g., flash memory or other electrically-programmable-read-only memory), volatile memory (e.g., battery-based static or dynamic random-access-memory), etc.

Processing circuitry 36 may be used to control the operation of device 10. Processing circuitry 36 may be based on a processor such as a microprocessor and other suitable integrated circuits. With one suitable arrangement, processing circuitry 36 and storage 34 are used to run software on device 10, such as internet browsing applications, voice-over-internet-protocol (VoIP) telephone call applications, email applications, media playback applications, operating system functions, etc. Processing circuitry 36 and storage 34 may be used in implementing suitable communications protocols. Communications protocols that may be implemented using processing circuitry 36 and storage 34 include internet protocols, wireless local area network protocols (e.g., IEEE 802.11 protocols—sometimes referred to as Wi-Fi®), protocols for other short-range wireless communications links such as the Bluetooth® protocol, protocols for handling 3 G communications services (e.g., using wide band code division multiple access techniques), 2G cellular telephone communications protocols, etc.

Input-output devices 38 may be used to allow data to be supplied to device 10 and to allow data to be provided from device 10 to external devices. Display screen 16, button 19, microphone port 24, speaker port 22, and dock connector port 20 are examples of input-output devices 38.

Input-output devices 38 can include user input-output devices 40 such as buttons, touch screens, joysticks, click wheels, scrolling wheels, touch pads, key pads, keyboards, microphones, cameras, etc. A user can control the operation of device 10 by supplying commands through user input devices 40. Display and audio devices 42 may include liquid-crystal display (LCD) screens or other screens, light-emitting diodes (LEDs), and other components that present visual information and status data. Display and audio devices 42 may also include audio equipment such as speakers and other devices for creating sound. Display and audio devices 42 may contain audio-video interface equipment such as jacks and other connectors for external headphones and monitors.

Wireless communications devices 44 may include communications circuitry such as radio-frequency (RF) transceiver circuitry formed from one or more integrated circuits, power amplifier circuitry, passive RF components, antennas, and other circuitry for handling RF wireless signals. Wireless signals can also be sent using light (e.g., using infrared communications).

Device 10 can communicate with external devices such as accessories 46, computing equipment 48, and wireless network 49 as shown by paths 50 and 51. Paths 50 may include wired and wireless paths. Path 51 may be a wireless path. Accessories 46 may include headphones (e.g., a wireless cellular headset or audio headphones) and audio-video equipment (e.g., wireless speakers, a game controller, or other equipment that receives and plays audio and video content), a peripheral such as a wireless printer or camera, etc.

Computing equipment 48 may be any suitable computer. With one suitable arrangement, computing equipment 48 is a computer that has an associated wireless access point (router) or an internal or external wireless card that establishes a wireless connection with device 10. The computer may be a server (e.g., an internet server), a local area network computer with or without internet access, a user's own personal computer, a peer device (e.g., another portable electronic device 10), or any other suitable computing equipment.

Wireless network 49 may include any suitable network equipment, such as cellular telephone base stations, cellular towers, wireless data networks, computers associated with wireless networks, etc. For example, wireless network 49 may include network management equipment that monitors the wireless signal strength of the wireless handsets (cellular telephones, handheld computing devices, etc.) that are in communication with network 49.

The antenna structures and wireless communications devices of device 10 may support communications over any suitable wireless communications bands. For example, wireless communications devices 44 may be used to cover communications frequency bands such as cellular telephone voice and data bands at 850 MHz, 900 MHz, 1800 MHz, 1900 MHz, and 2100 MHz (as examples). Devices 44 may also be used to handle the Wi-Fi® (IEEE 802.11) bands at 2.4 GHz and 5.0 GHz (also sometimes referred to as wireless local area network or WLAN bands), the Bluetooth® band at 2.4 GHz, and the global positioning system (GPS) band at 1575 MHz.

Device 10 can cover these communications bands and/or other suitable communications bands using the antenna structures in wireless communications circuitry 44. As an example, a pentaband cellular telephone antenna may be provided at one end of device 10 (e.g., in region 18) to handle 2G and 3G voice and data signals and a dual band antenna may be provided at another end of device 10 (e.g., in region 21) to handle GPS and 2.4 GHz signals. The pentaband antenna may be used to cover wireless bands at 850 MHz, 900 MHz, 1800 MHz, 1900 MHz, and 2100 MHz (as an example). The dual band antenna 63 may be used to handle 1575 MHz signals for GPS operations and 2.4 GHz signals (for Bluetooth® and IEEE 802.11 operations). These are merely illustrative arrangements. Any suitable antenna structures may be used in device 10 if desired.

To facilitate manufacturing operations, device 10 may be formed from two intermediate assemblies, representing upper and lower portions of device 10. The upper or top portion of device 10 is sometimes referred to as a tilt assembly. The lower or bottom portion of device 10 is sometimes referred to as a housing assembly.

The tilt and housing assemblies are each formed from a number of smaller components. For example, the tilt assembly may be formed from components such as display 16 and an associated touch sensor. The housing assembly may include a plastic housing portion 12, bezel 14, and printed circuit boards. Integrated circuits and other components may be mounted on the printed circuit boards.

During initial manufacturing operations, the tilt assembly may be formed from its constituent parts and the housing assembly may be formed from its constituent parts. Because essentially all components in device 10 make up part of these two assemblies with this type of arrangement, the finished assemblies represent a nearly complete version of device 10. The finished assemblies may, if desired, be tested. If testing reveals a defect, repairs may be made or defective assemblies may be discarded. During a final set of manufacturing operations, the tilt assembly is inserted into the housing assembly. With one suitable arrangement, one end of the tilt assembly is inserted into the housing assembly. The tilt assembly is then rotated ("tilted") into place so that the upper surface of the tilt assembly lies flush with the upper edges of the housing assembly.

As the tilt assembly is rotated into place within the housing assembly, clips on the tilt assembly engage springs on the housing assembly. The clips and springs form a detent that helps to align the tilt assembly properly with the housing assembly. Should rework or repair be necessary, the insertion process can be reversed by rotating the tilt assembly up and away from the housing assembly. During rotation of the tilt assembly relative to the housing assembly, the springs flex to accommodate movement. When the tilt assembly is located within the housing assembly, the springs press into holes in the clips to prevent relative movement between the tilt and housing assemblies. Rework and repair operations need not be destructive to the springs, clips, and other components in the device. This helps to prevent waste and complications that might otherwise interfere with the manufacturing of device 10.

If desired, screws or other fasteners may be used to help secure the tilt assembly to the housing assembly. The screws may be inserted into the lower end of device 10. With one suitable arrangement, the screws are inserted in an unobtrusive portion of the end of device 10 so that they are not noticeable following final assembly operations. Prior to rework or repair operations, the screws can be removed from device 10.

Figure 3:
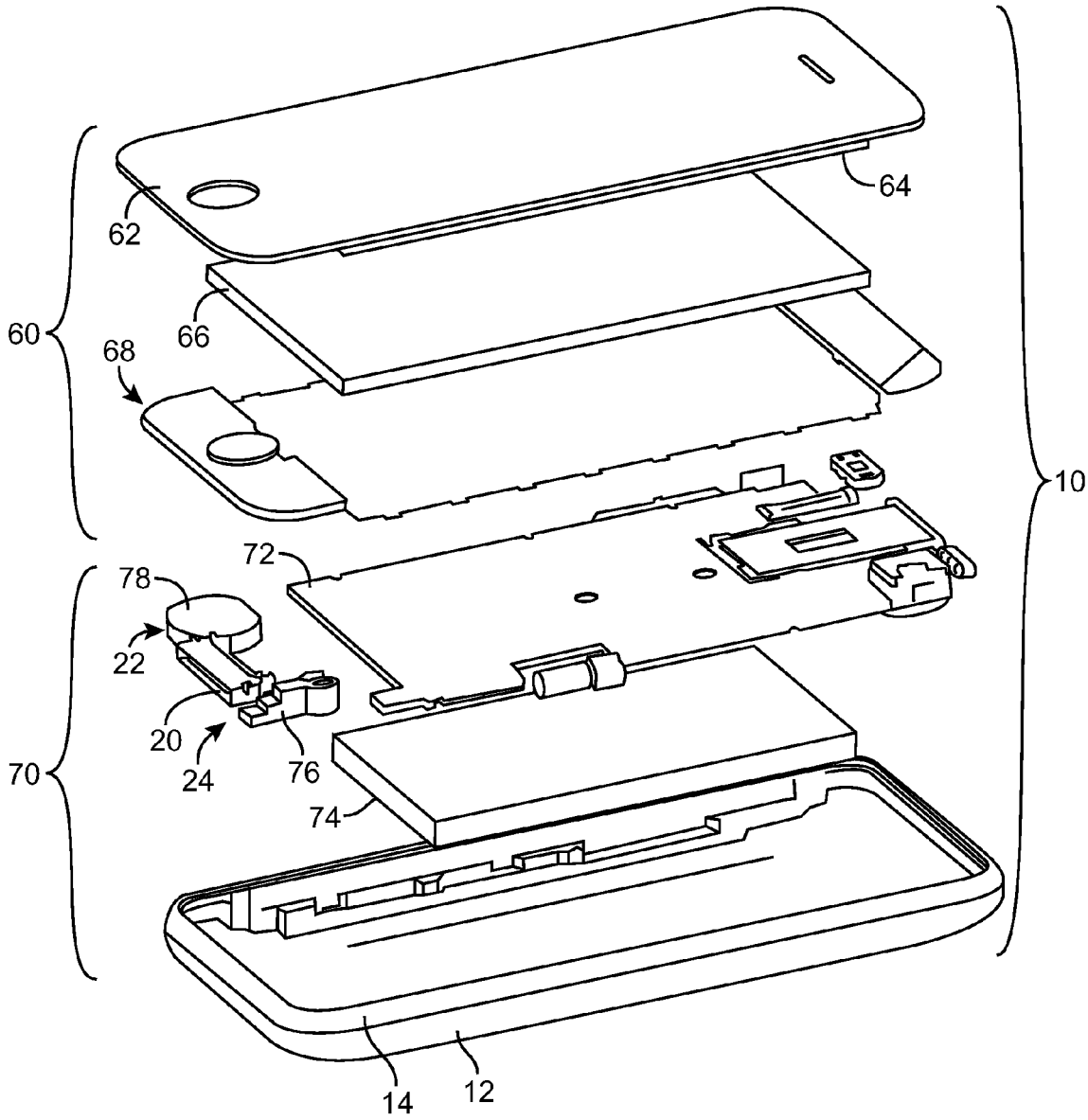
FIG. 3 is an exploded perspective view of an illustrative portable electronic device in accordance with an embodiment of the present invention.

An exploded perspective view showing illustrative components of device 10 is shown in FIG. 3.

Tilt assembly 60 (shown in its unassembled state in FIG. 3) may include components such as cover 62, touch sensitive sensor 64 (e.g., a capacitive multitouch sensor), display unit 66, and frame 68. Cover 62 may be formed of glass or other suitable transparent materials (e.g., plastic, combinations of one or more glasses and one or more plastics, etc.). Display unit 66 may be, for example, a color liquid crystal display. Frame 68 may be formed from one or more pieces. With one suitable arrangement, frame 68 may include metal pieces to which plastic parts are connected using an overmolding process. If desired, frame 68 may be formed entirely from plastic or entirely from metal.

Housing assembly 70 (shown in its unassembled state in FIG. 3) may include housing 12. Housing 12 may be formed of plastic and/or other materials such as metal (metal alloys). For example, housing 12 may be formed of plastic to which metal members are mounted using fasteners, a plastic overmolding process, or other suitable mounting arrangement.

As shown in FIG. 3, handheld electronic device 10 may have a bezel such as bezel 14. Bezel 14 may be formed of plastic or other dielectric materials or may be formed from metal or other conductive materials. An advantage of a metal (metal alloy) bezel is that materials such as metal may provide bezel 14 with an attractive appearance and may be durable. If desired, bezel 14 may be formed from shiny plastic or plastic coated with shiny materials such as metal films.

Bezel 14 may be mounted to housing 12. Following final assembly, bezel 14 may surround the display of device 10 and may, if desired, help secure the display onto device 10. Bezel 14 may also serve as a cosmetic trim member that provides an attractive finished appearance to device 10.

Housing assembly 70 may include battery 74. Battery 74 may be, for example, a lithium polymer battery having a capacity of about 1300 mA-hours. Battery 74 may have spring contacts that allow battery 74 to be serviced.

Housing assembly 70 may also include one or more printed circuit boards such as printed circuit board 72. Components may be mounted to printed circuit boards such as microphone 76 for microphone port 24, speaker 78 for speaker port 22, and dock connector 20, integrated circuits, a camera, ear speaker, audio jack, buttons, SIM card slot, etc.

Figure 4:
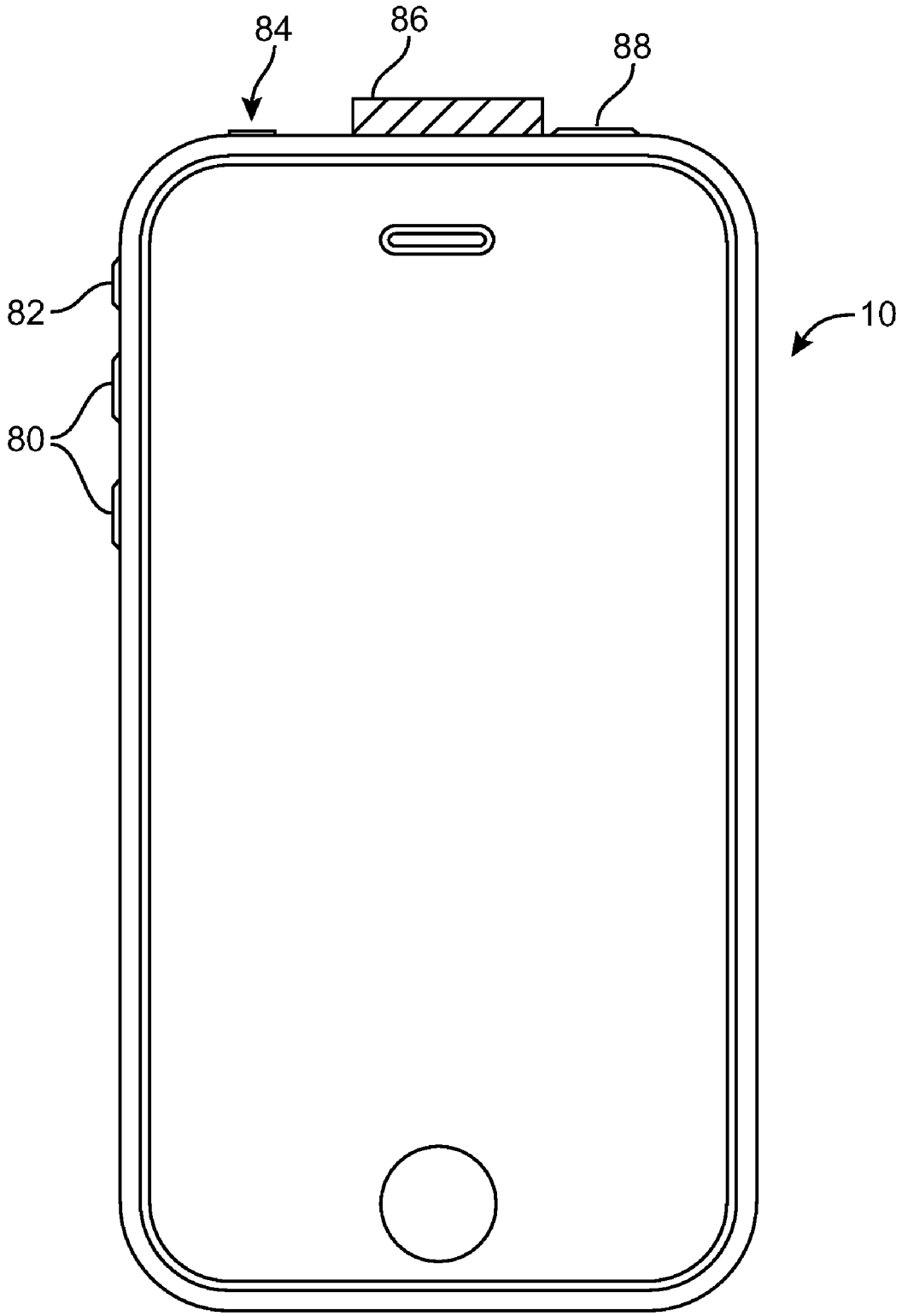
FIG. 4 is a top view of an illustrative portable electronic device in accordance with an embodiment of the present invention.

A top view of an illustrative device 10 is shown in FIG. 4. As shown in FIG. 4, device 10 may have controller buttons such as volume up and down buttons 80, a ringer A/B switch 82 (to switch device 10 between ring and vibrate modes), and a hold button 88 (sleep/wake button). A Subscriber Identity Module (SIM) tray 86 (shown in a partially extended state) may be used to receive a SIM card for authorizing cellular telephone services. Audio jack 84 may be used for attaching audio peripherals to device 10 such as headphone, a headset, etc.

Figure 5:
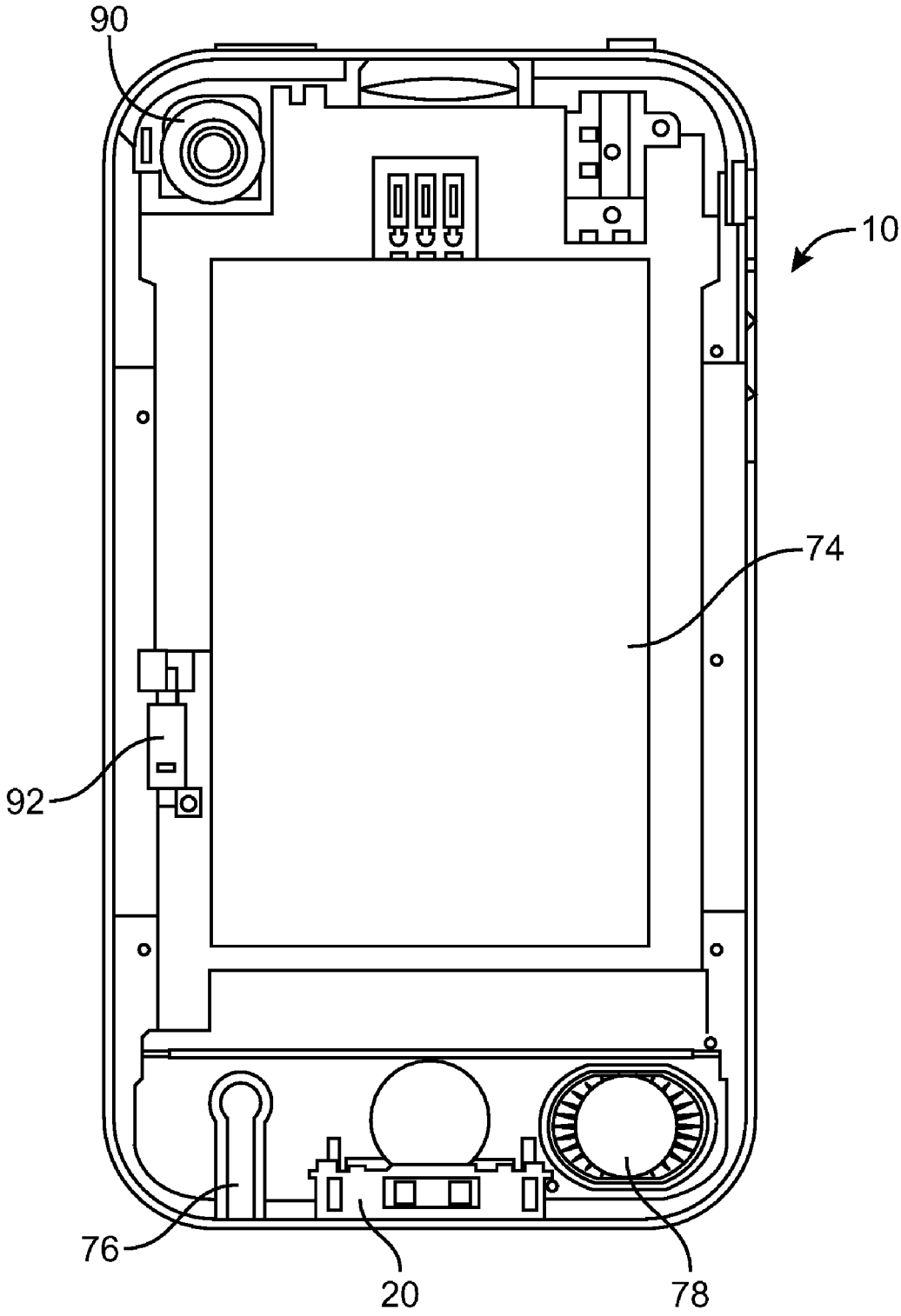
FIG. 5 is an interior bottom view of an illustrative portable electronic device in accordance with an embodiment of the present invention.

An interior bottom view of device 10 is shown in FIG. 5. As shown in FIG. 5, device 10 may have a camera 90. Camera 90 may be, for example, a two megapixel fixed focus camera.

Vibrator 92 may be used to vibrate device 10. Device 10 may be vibrated at any suitable time. For example, device 10 may be vibrated to alert a user to the presence of an incoming telephone call, an incoming email message, a calendar reminder, a clock alarm, etc.

Battery 74 may be a removable battery that is installed in the interior of device 10 adjacent to dock connector 20, microphone 76, and speaker 78.

Figure 6:
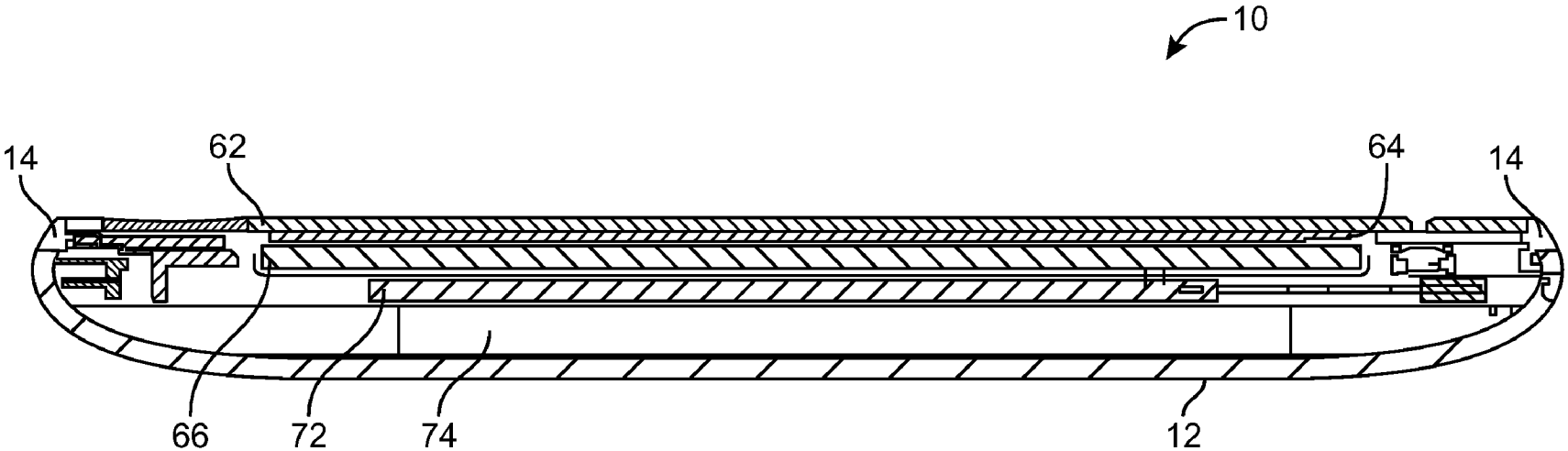
FIG. 6 is a side view of an illustrative portable electronic device in accordance with an embodiment of the present invention.

A cross-sectional side view of device 10 is shown in FIG. 6. FIG. 6 shows the relative vertical positions of device components such as housing 12, battery 74, printed circuit board 72, liquid crystal display unit 66, touch sensor 64, and cover glass 62 within device 10. FIG. 6 also shows how bezel 14 may surround the top edge of device 10 (e.g., around the portion of device 10 that contains the components of display 16 such as cover 62, touch screen 64, and display unit 66). Bezel 14 may be a separate component or, if desired, one or more bezel-shaped structures may be formed as integral parts of housing 12 or other device structures.

Figure 7:
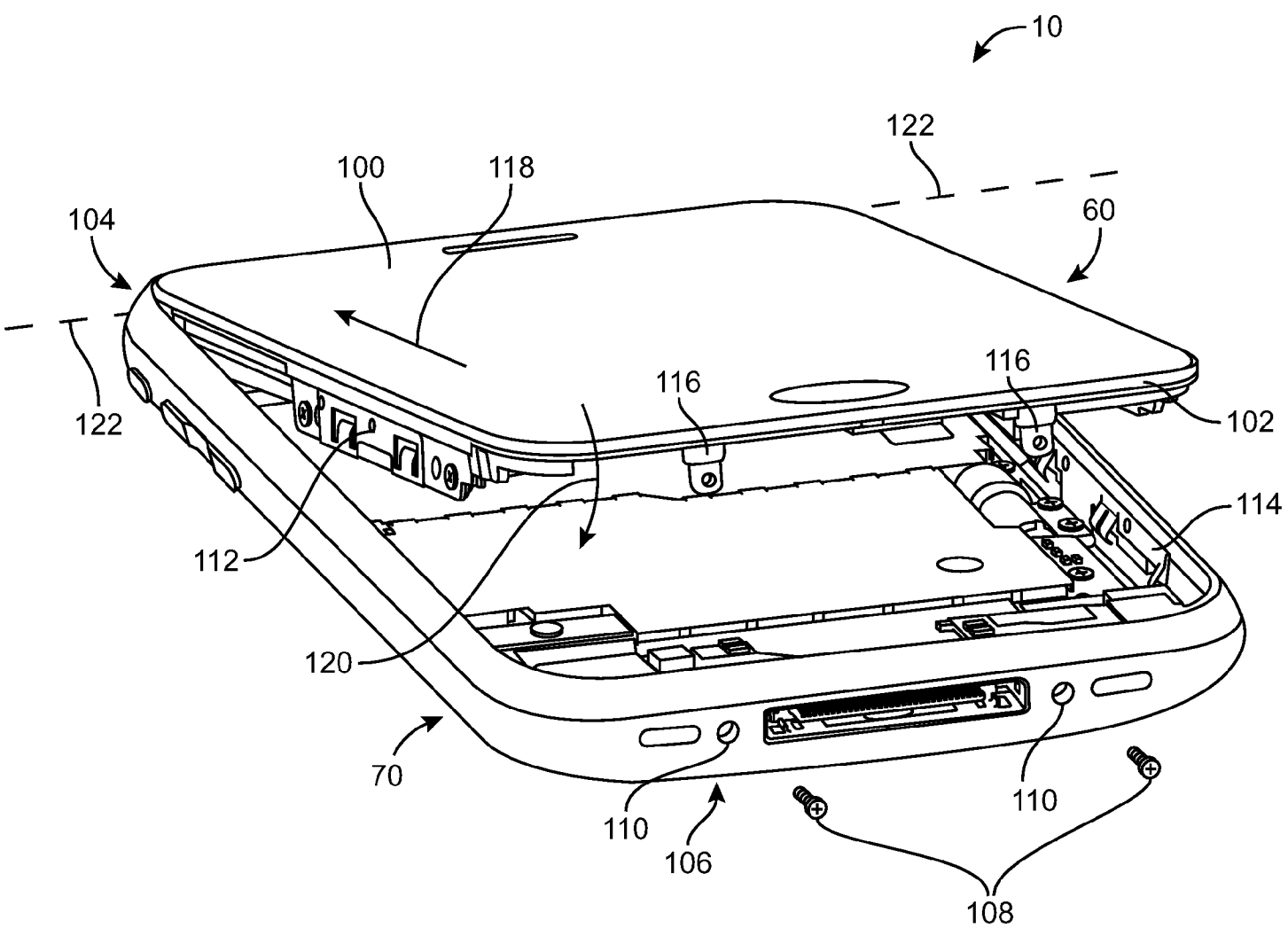
FIG. 7 is a perspective view of a partially assembled portable electronic device in accordance with an embodiment of the present invention showing how an upper portion of the device may be inserted into a lower portion of the device.

Device 10 may be assembled from tilt assembly 60 and housing assembly 70. As shown in FIG. 7, the assembly process may involve inserting upper end 100 of tilt assembly 60 into upper end 104 of housing assembly 70 along direction 118 until protrusions on the upper end of tilt assembly 60 engage mating holes on housing assembly 70. Once the protrusions on tilt assembly 60 have engaged with housing assembly 70, lower end 102 of tilt assembly 60 may be inserted into lower end 106 of housing assembly 70. Lower end 102 may be inserted into lower end 106 by pivoting tilt assembly 60 about pivot axis 122. This causes tilt assembly 60 to rotate into place as indicated by arrow 120.

Tilt assembly 60 may have clips such as clips 112 and housing assembly 70 may have matching springs 114. When tilt assembly 60 is rotated into place within housing assembly 70, the springs and clips mate with each other to hold tilt assembly 60 in place within housing assembly 70.

Tilt assembly 60 may have one or more retention clips such as retention clips 116. Retention clips 116 may have threaded holes that mate with screws 108. After tilt assembly has been inserted into housing assembly, screws 108 may be screwed into retention clips 116 through holes 110 in housing assembly 70. This helps to firmly secure tilt assembly 60 to housing assembly 70. Should rework or repair be desired, screws 108 may be removed from retention clips 116 and tilt assembly 60 may be released from housing assembly 70. During the removal of tilt assembly 60 from housing assembly 70, springs 114 may flex relative to clips 112 without permanently deforming. Because no damage is done to tilt assembly 60 or housing assembly 70 in this type of scenario, nondestructive rework and repair operations are possible.

Figure 8:
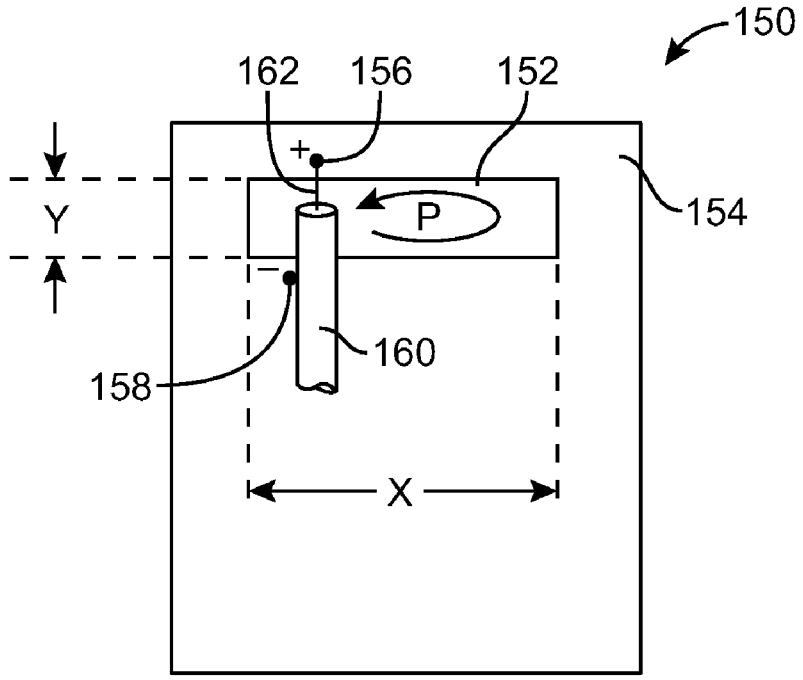
FIG. 8 is a top view of an illustrative slot antenna structure in accordance with an embodiment of the present invention.

Device 10 may have a hybrid antenna that has the attributes of both a slot antenna and a non-slot antenna such as an inverted-F antenna. A top view of a slot antenna structure 150 is shown in FIG. 8. Slot 152 may be formed within ground plane 154. Slot 152 may be filled with a dielectric. For example, portions of slot 152 may be filled with air and portions of slot 152 may be filled with solid dielectrics such as plastic. A coaxial cable 160 or other transmission line path may be used to feed antenna structure 150. In the example of FIG. 8, antenna structure 150 is being fed so that the center conductor 162 of coaxial cable 160 is connected to signal terminal 156 (i.e., the positive or feed terminal of antenna structure 150) and the outer braid of coaxial cable 160, which forms the ground conductor for cable 160, is connected to ground terminal 158.

Figure 9:
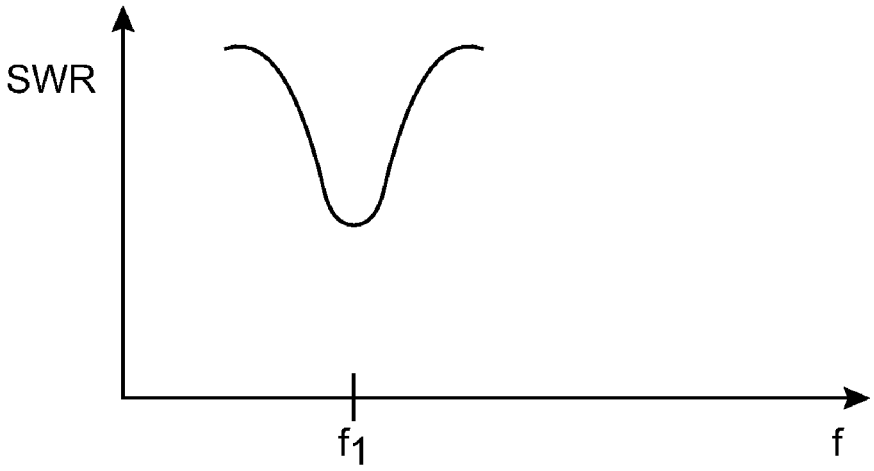
FIG. 9 is an illustrative graph showing antenna performance as a function of frequency for an illustrative slot antenna structure of the type shown in FIG. 8 in accordance with an embodiment of the present invention.

The performance of a slot antenna structure such as antenna structure 150 of FIG. 8 may be characterized by a graph such as the graph of FIG. 9. As shown in FIG. 9, slot antenna structure 150 operates in a frequency band that is centered about center frequency $f_1$. The center frequency $f_1$ may be determined by the dimensions of slot 152. In the illustrative example of FIG. 8, slot 152 has an inner perimeter P that is equal to two times dimension X plus two times dimension Y (i.e., P=2X+2Y). (In general, the perimeter of slot 152 may be irregular.) At center frequency $f_1$, perimeter P is equal to one wavelength. The position of terminals 158 and 156 may be selected to help match the impedance of antenna structure 150 to the impedance of transmission line 160. If desired, terminals such as terminals 156 and 158 may be located at other positions about slot 152. In the illustrative arrangement of FIG. 8, terminals 156 and 158 are shown as being respectively configured as a slot antenna signal terminal and a slot antenna ground terminal, as an example. If desired, terminal 156 could be used as a ground terminal and terminal 158 could be used as a signal terminal.

In forming a hybrid antenna for device 10, a slot antenna structure such as slot antenna structure 150 of FIG. 8 may be used in conjunction with an additional antenna structure such as an inverted-F antenna structure.

Figure 10:
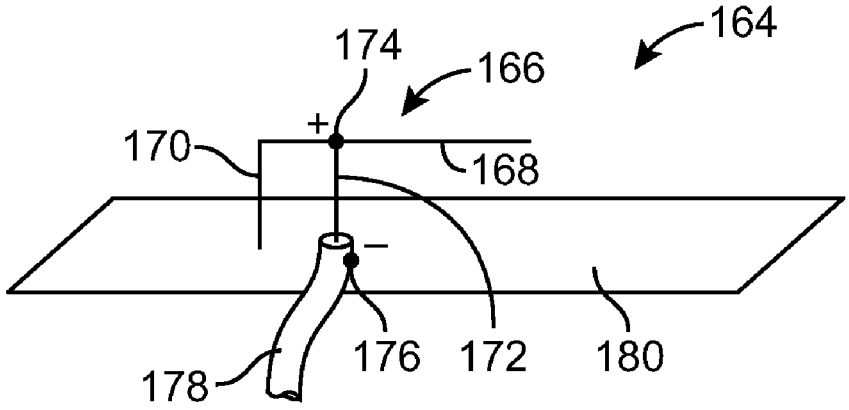
FIG. 10 is a perspective view of an illustrative inverted-F antenna structure in accordance with an embodiment of the present invention.

A perspective view of an illustrative inverted-F antenna structure is shown in FIG. 10. As shown in FIG. 10, inverted-F antenna structure 164 may have a resonating element 166 that extends upwards from ground plane 180. Element 166 may have a vertically extending portion such as portion 170 and horizontally extending portion 168. Horizontally extending portion 168, which may sometimes be referred to as an arm, may have one or more bends or other such features. Inverted-F antenna resonating element 166 may be fed by a transmission line such as coaxial cable 178. In the example of FIG. 10, antenna structure 164 is being fed so that center conductor 172 of coaxial cable 178 is connected to signal terminal 174 (i.e., the positive terminal of antenna structure 164) and the outer braid of coaxial cable 178, which forms the ground conductor for cable 178, is connected to antenna ground terminal 176. The position of the feed point for antenna structure 164 along the length of resonating element arm 168 may be selected for impedance matching between antenna structure 164 and transmission line 178.

Figure 11:
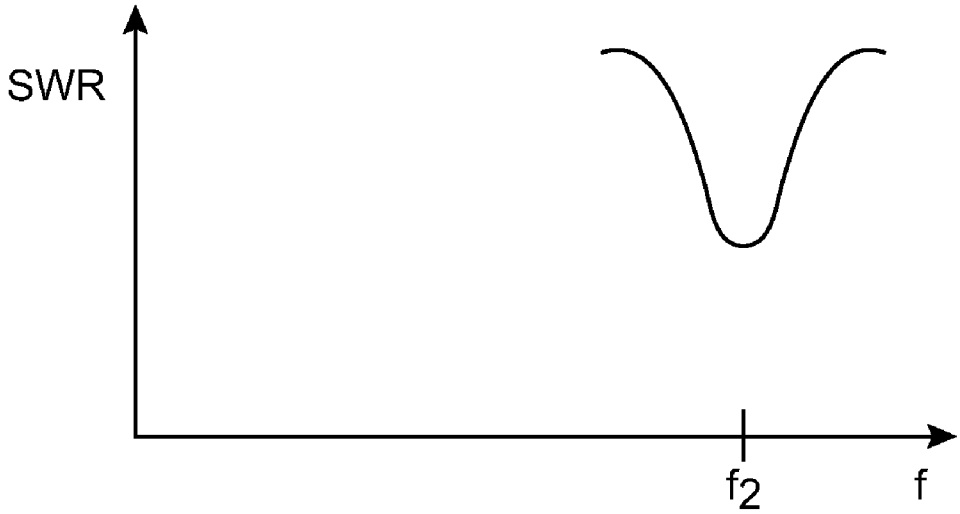
FIG. 11 is an illustrative graph showing antenna performance as a function of frequency for an illustrative inverted-F antenna structure of the type shown in FIG. 10 in accordance with an embodiment of the present invention.

The performance of an antenna structure such as inverted-F antenna structure 164 of FIG. 10 may be characterized by a graph such as the graph of FIG. 11. As shown in FIG. 11, antenna structure 164 may operate in a frequency band that is centered about center frequency $f_2$. The center frequency $f_2$ may be determined by the dimensions of antenna resonating element 166 (e.g., the length of arm 168 may be approximately a quarter of a wavelength).

Figure 12:
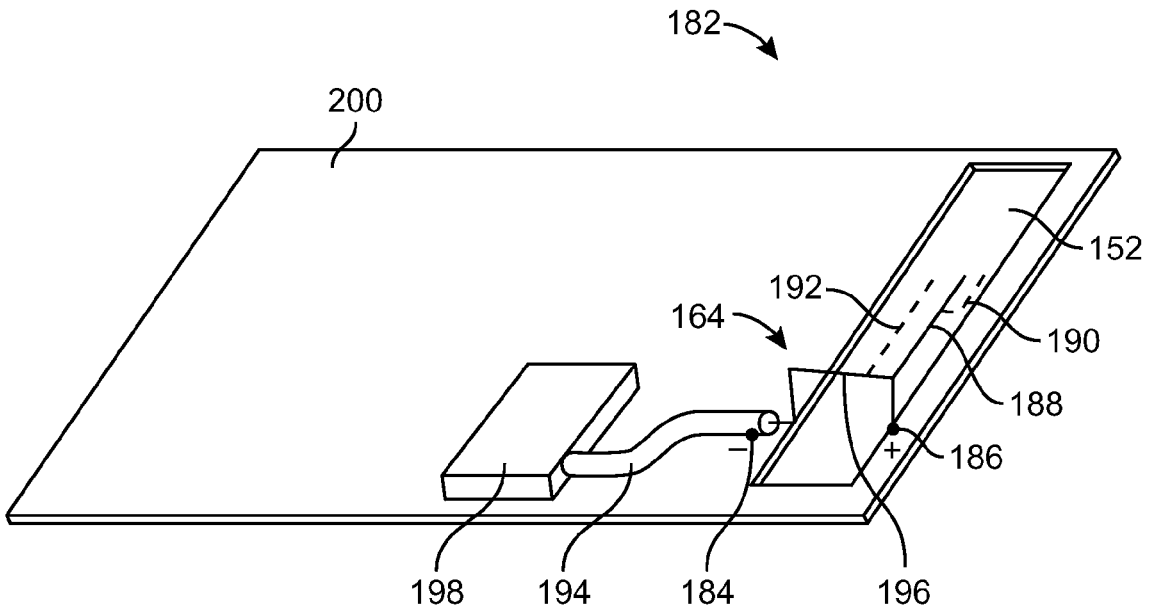
FIG. 12 is a perspective view of an illustrative hybrid inverted-F-slot antenna in accordance with an embodiment of the present invention.

A hybrid antenna may be formed by combining a slot antenna structure of the type shown in FIG. 8 with an inverted-F antenna structure of the type shown in FIG. 10. This type of arrangement is shown in FIG. 12. As shown in FIG. 12, antenna 182 may include an inverted-F antenna structure 164 and a slot antenna structure. The slot antenna structure may be formed from a slot in ground plane 200 such as slot 152. Ground plane 200 may be formed by conductive housing members, printed circuit boards, bezel 14, electrical components, etc. Slot 152 of FIG. 12 is shown as being rectangular, but in general, slot 152 may have any suitable shape (e.g., an elongated irregular shape determined by the sizes and shape of conductive structures in device 10). Inverted-F antenna structure 164 may have an arm such as arm 188. As shown by dashed line 192, the position of arm 192 may be changed if desired. Arms such as arms 188 and 192 may have one or more bends, as illustrated by dashed line 190. Multiarm arrangements may also be used.

Radio-frequency signals may be transmitted and received using transmitters and receivers. For example, global positioning system (GPS) signals may be received using a GPS receiver. Local wireless signals for communicating with accessories and local area networks may be transmitted and received using transceiver circuitry. Circuitry 198 of FIG. 12 may include circuitry such as receiver circuitry for receiving GPS signals at 1575 MHz and transceiver circuitry for handling local wireless signals at 2.4 GHz (as an example). A diplexer or other suitable device may be used to share hybrid antenna 182 between a GPS receiver and 2.4 GHz transceiver circuits in circuitry 198 if desired.

Transceiver circuitry 198 may be coupled to antenna 182 using one or more transmission line structures. For example, a transmission line such as coaxial cable 194 may be used to feed antenna 182 at signal terminal 186 and at ground terminal 184. Conductive portion 196 of inverted-F antenna structure 164 serves to bridge slot 152, so that the positive and ground antenna feed terminals feed the slot portion of antenna 182 at suitable locations.

Figure 13:
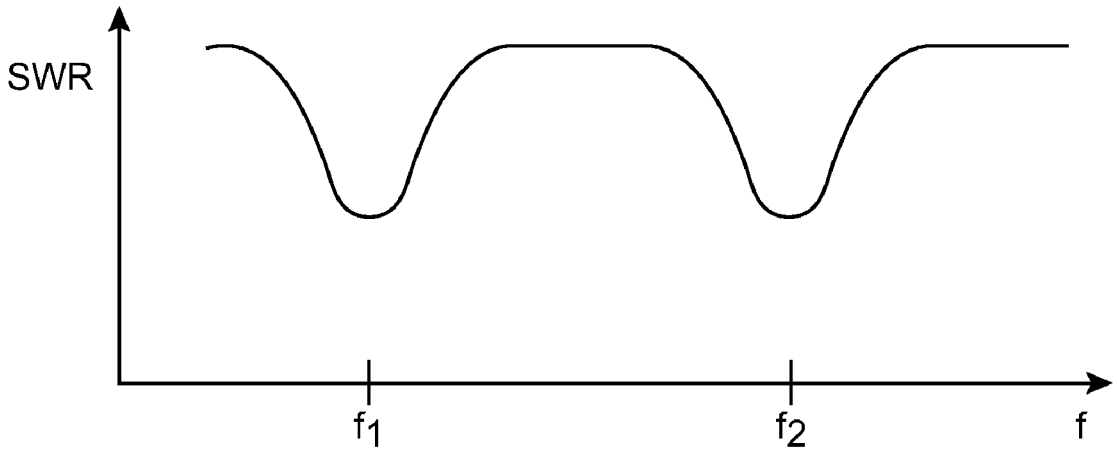
FIG. 13 is a graph showing antenna performance for a hybrid antenna of the type shown in FIG. 12 in accordance with the present invention.

Hybrid antennas such as hybrid antenna 182 of FIG. 12 may cover multiple communications bands. As shown in FIG. 13, for example, the sizes of slot 152 and inverted-F structure 164 may be chosen so that slot 152 resonates at a first frequency f1, whereas inverted-F structure 164 resonates at a second frequency f2. Frequency f1 may, for example, be 1575 MHz and frequency f2 may be 2.4 GHz (as an example). With this type of arrangement, the slot antenna structure handles GPS signals, whereas the inverted-F antenna structure handles 2.4 GHz signals for IEEE 802.11 and Bluetooth® communications. There need not be any harmonic relationship between frequencies f1 and f2 (i.e., f2 need not be equal to an integer multiple of f1), which allows for freedom in designing antennas of the type shown in FIG. 12 to cover desired frequencies f1 and f2 that are not harmonically related.

Figure 14:
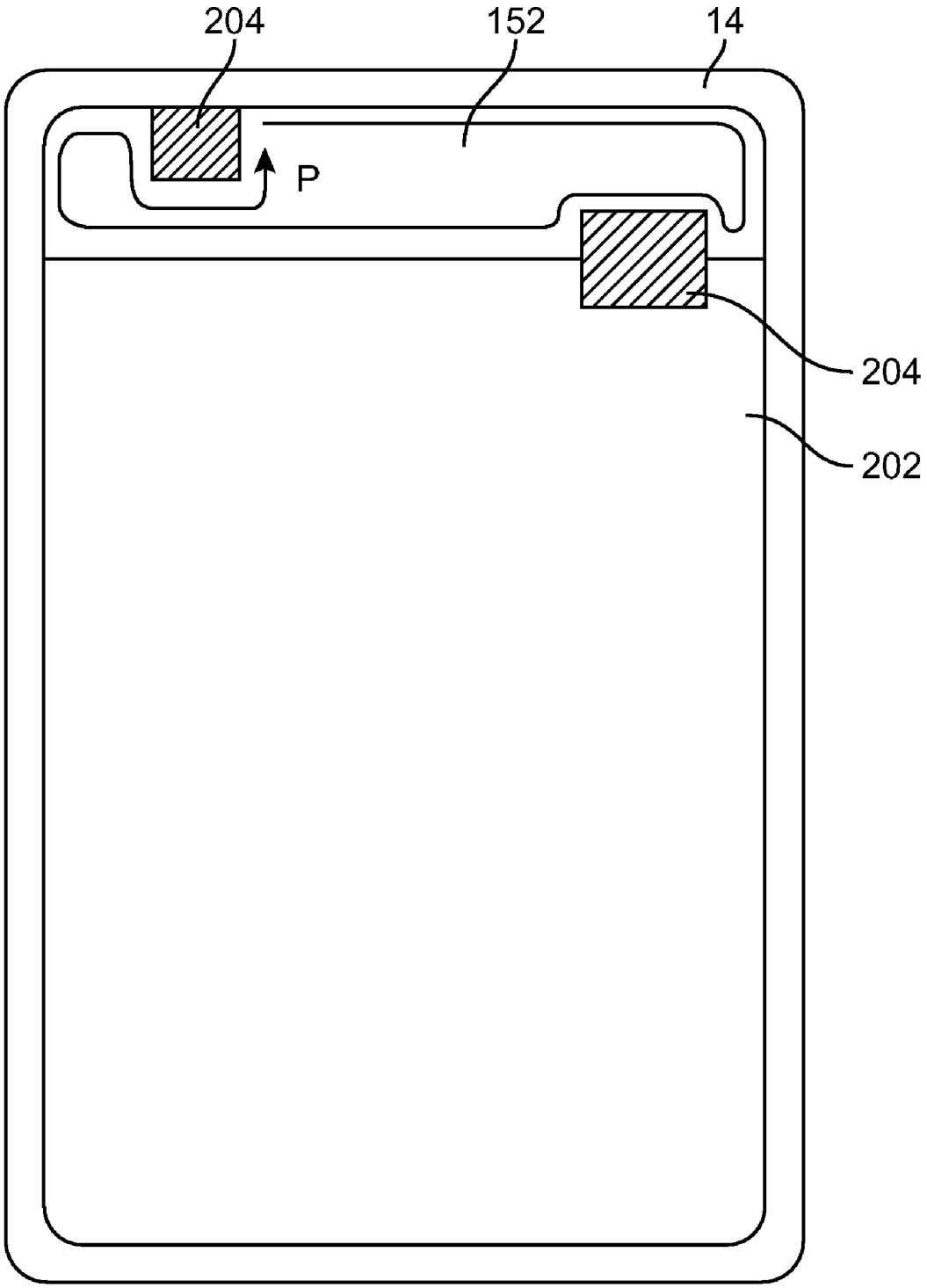
FIG. 14 is a top view of an illustrative slot antenna structure formed from portions of a handheld electronic device in accordance with an embodiment of the present invention.

The shape of slot 152 may be determined by the shapes and locations of conductive structures in device 10 such as electrical components, flex circuit structures used for interconnecting electrical components (i.e., flexible printed circuit board structures based on polyimide substrates), printed circuit board conductors, metal housing structures, metal brackets, bezel 14, etc. This is illustrated in the top view of FIG. 14. As shown in FIG. 14, slot 152 may have an inner perimeter P that is defined along its upper side by bezel 14 and along its lower side by printed circuit board 202. Conductive structure 204 (e.g., metal structures, electrical components, flex circuits, etc.) intrude on the generally rectangular slot shape formed between bezel 14 and printed circuit board 202 and thereby modify the location and length of perimeter P. Conductive structures in device 10 such as bezel 14, printed circuit board 202, and components 204 may have non-negligible thicknesses (i.e., vertical height in the "z" dimension perpendicular to the page of FIG. 14), so in practice, the location and length of perimeter P may also be affected by the shape and size of the conductive structures of device 10 in this vertical dimension.

Figure 15:
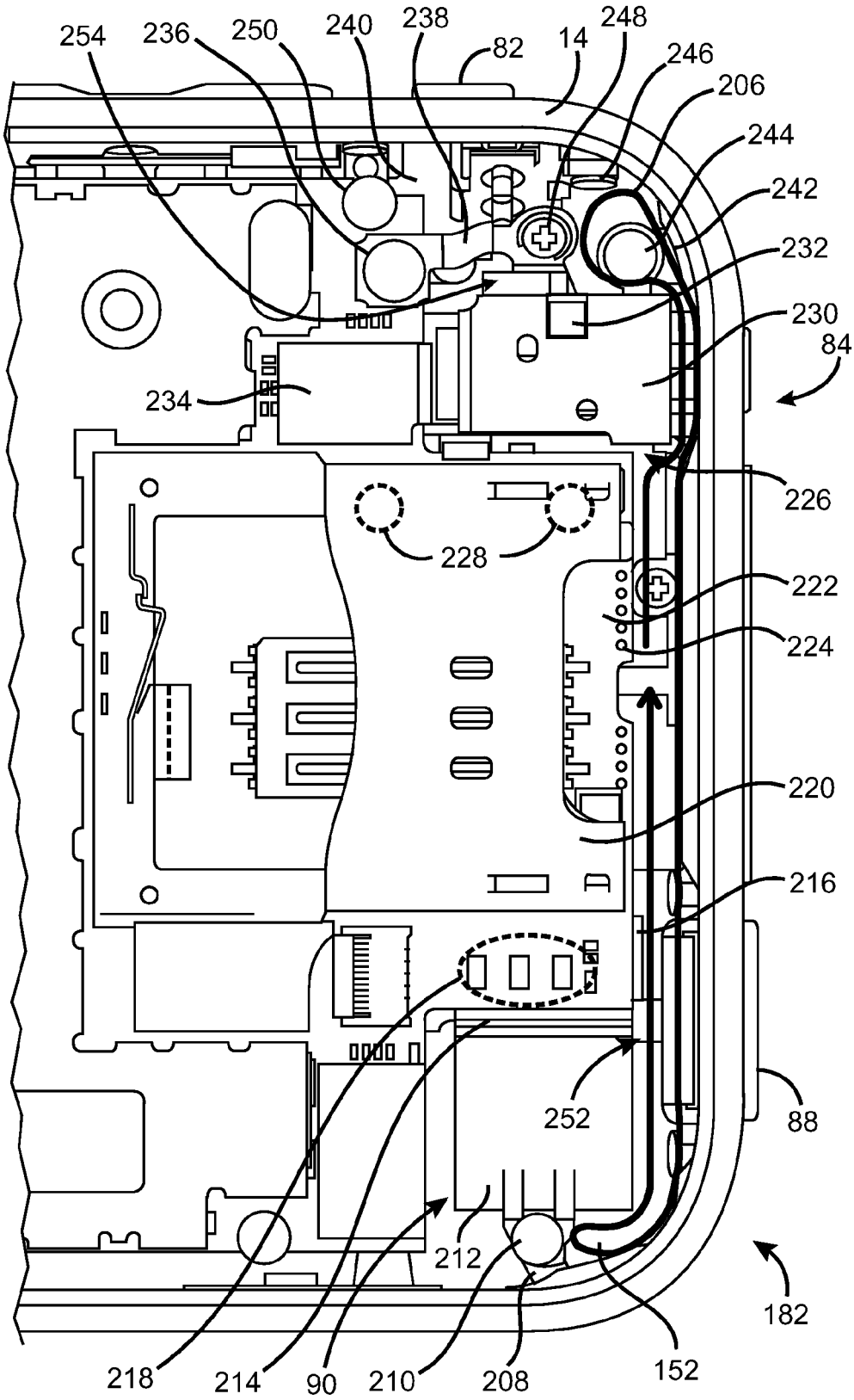
FIG. 15 is a top view of an illustrative slot antenna structure formed from illustrative electrical components in a handheld electronic device in accordance with an embodiment of the present invention.

A top view of a portion of device 10 in the vicinity of antenna 182 is shown in FIG. 15. Line 206 follows the inner perimeter of slot 152. The shape of slot 152 is determined by conductive portions of device 10 such as bezel 14 (which extends along most of the right side of slot 152), printed circuit board 222 (which extends along much of the left side of slot 152), and various other electrical structures in device 10.

Part of the left side of slot 152 may, for example, be determined by the position of the conductive components of camera 90. Camera 90 may have a stiffener 212 that helps to provide structural rigidity. Stiffener 212 may be connected to camera bracket 208 via screw 210. Camera bracket 208 may be welded to bezel 14. Flex circuit 214 may be used to electrically interconnect camera 90 and circuitry on printed circuit board 222 and may form part of the left side of slot 152. On one end, camera flex 214 may be connected to camera 90. On its other end, camera flex 214 may be connected to a board-to-board connector mounted to printed circuit board 222 such as board-to-board connector 216. Board-to-board connector 216 may be mounted to the underside of printed circuit board 222 under region 218. Printed circuit board 222 may form a main logic board in device 10. The top surface of printed circuit board 222 may form part of a DC ground for device 10.

Subscriber Identity Module (SIM) card cage 220 may be connected to printed circuit board 222 (e.g., using solder). With one suitable arrangement, SIM cage 220 is formed of a conductive material such as metal. Vias such as vias 224 may be formed along the edge of printed circuit board 222 to ensure that printed circuit board 222 forms a well defined ground conductor along the left edge of slot 152.

Audio jack 84 may have an associated audio flex circuit (e.g., flex circuit 230 and associated flex circuit portion 234). These structures may make the upper portion of audio jack 84 conductive. The right hand edge of flex circuit 230 may define part of the left edge of slot 152.

There may be discontinuities between the conductive structures that ring slot 152. For example, there may be a gap 226 between flex circuit 230 and printed circuit board 222 (and SIM cage 220). Gaps such as gap 226 may be bridged by conductive structures that are formed on other parts of device 10. For example, if SIM cage 220, printed circuit board 222, and audio flex circuit 230 are formed on part of housing assembly 70, conductive structures on tilt assembly 60 may be used to electrically bridge gap 226. These bridging structures may help form a completely closed slot shape for slot 152. The bridging structures may span gap 226 by electrically connecting conductive structures on one side of gap 226 such as points 228 on SIM cage 220 with conductive structures on the other side of gap 226 such as conductive pad 232 on flex circuit 230. If desired, gaps may be spanned using springs in the gaps or using solder. An advantage of spanning gaps such as gap 226 with electrically conductive bridging structures on tilt assembly 60 is that this type of arrangement avoids the need to place springs in small gaps (where space is at a premium) and, unlike solder joints in the gaps, can permit nondestructive removal of structures such as printed circuit boards (e.g., for rework or repair or for servicing a battery).

Inverted-F antenna structure 164 (FIG. 12) may be mounted to the underside of device 10 (as viewed in FIG. 15) at the upper end of slot 152 (as viewed in FIG. 15). Transceiver circuitry (e.g., transceiver circuitry 198 of FIG. 12) may be mounted on printed circuit board 222. The transceiver circuitry may be interconnected with antenna 182 using transmission line paths. For example, a coaxial cable may be used to connect transceiver circuitry to coaxial cable connector 236 (e.g., a mini UFL connector). Coaxial cable connector 236 may be connected to a microstrip transmission line formed from flex circuit 238. Flex circuit 238 may include a positive conductor and a ground conductor. The ground conductor in flex circuit 238 may be shorted to ringer bracket 240 using screw 248

Ringer bracket 240 may be formed from a conductive material such as metal and may be connected to bezel 14 using screw 246. Because ringer bracket 240 is electrically connected to both the ground line in flex 238 and bezel 14, ringer bracket 240 serves to short the antenna ground line from flex circuit 238 to bezel 14. Printed circuit board 222 (e.g., DC ground) can be shorted to ringer bracket 240 (and therefore bezel 14) via screw 250. There may be an electrical gap 254 in slot 152 (similar to gap 226) between audio jack flex 230 and ringer bracket 240. Gap 254 may be bridged by conductive structures formed on tilt assembly 60. These conductive structures may form an electrical bridge between point 232 on flex 230 and ringer bracket 240, thereby completing the perimeter of slot 152.

Ringer A/B switch 82 may be mounted to device 10 using ringer bracket 240. A protruding plastic portion of audio jack 84 may be connected to bezel 14 using audio jack bracket 242 and screw 244. This mounting scheme preferably does not cause conductive elements in audio jack 84 to substantially intrude into the perimeter of slot 154. Moreover, conductive structures can be electrically isolated using appropriate isolation elements. Using this type of isolation scheme, the shape of slot 152 may be preserved, even when potentially intrusive conductive structures overlap somewhat with slot 152. As an example, a flex circuit (sometimes referred to as the audio button flex) may be used to interconnect button 88 with audio jack flex 230. This flex circuit may span slot 152 as shown by flex 252. Resistors, inductors, or other isolation elements may be located on flex circuit 252 to isolate flex circuit 252 from slot 252 at the radio frequencies at which antenna 182 operates. These isolation elements may, for example, be located adjacent to the left of slot 152 on flex circuit 252 and at other locations on the audio button flex and other such flex circuits. When the isolation elements are used, the size and shape of slot 152 is unaffected, even when spanned by conductive structures such as flex circuit strips.

Figure 16:
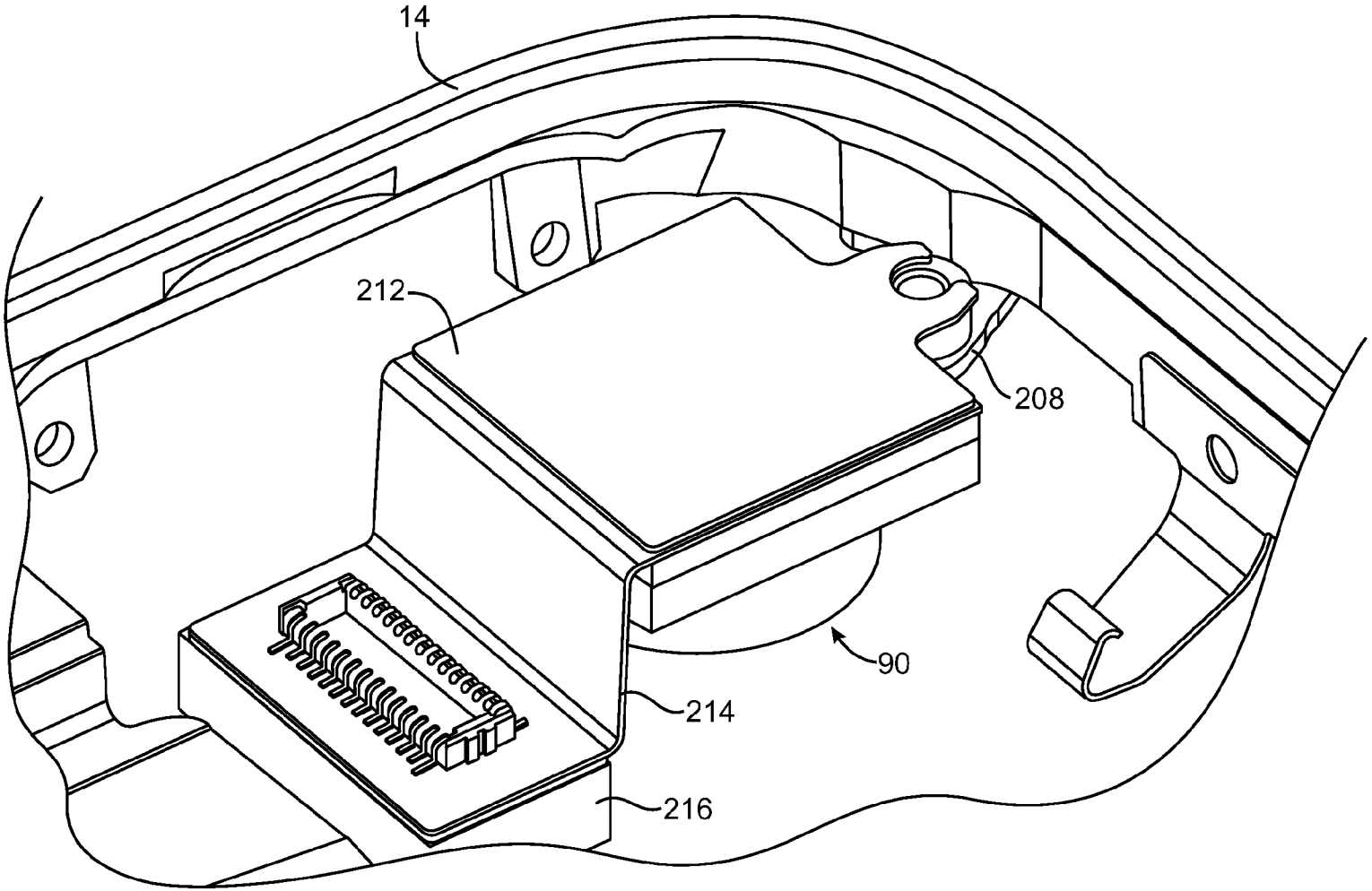
FIG. 16 is a perspective view of a portion of a handheld electronic device showing how a camera unit may be mounted within the device adjacent to an antenna slot region in accordance with an embodiment of the present invention.

A perspective view of camera 90 is shown in FIG. 16. As shown in FIG. 16, flex circuit 214 may be used to electrically connect camera unit 90 to board-to-board connector 216. Flex circuit 214 may include thickened conductive traces to help flex circuit 214 form part of the ground plane for antenna 182. (Printed circuit board 222 is not shown in FIG. 16, so that the position of board-to-board connector 216 may be presented in an unobstructed view.) Stiffener 212 may be mounted to camera 90 on top of flex circuit 214. Stiffener plate 212 may be at DC ground or may be floating. Camera bracket 208 (sometimes referred to as a camera tang or camera mounting structure) may be welded to bezel 14. During assembly, camera 90 may be attached to device 10 by screwing screw 210 (FIG. 16) into bracket 208.

Figure 17:
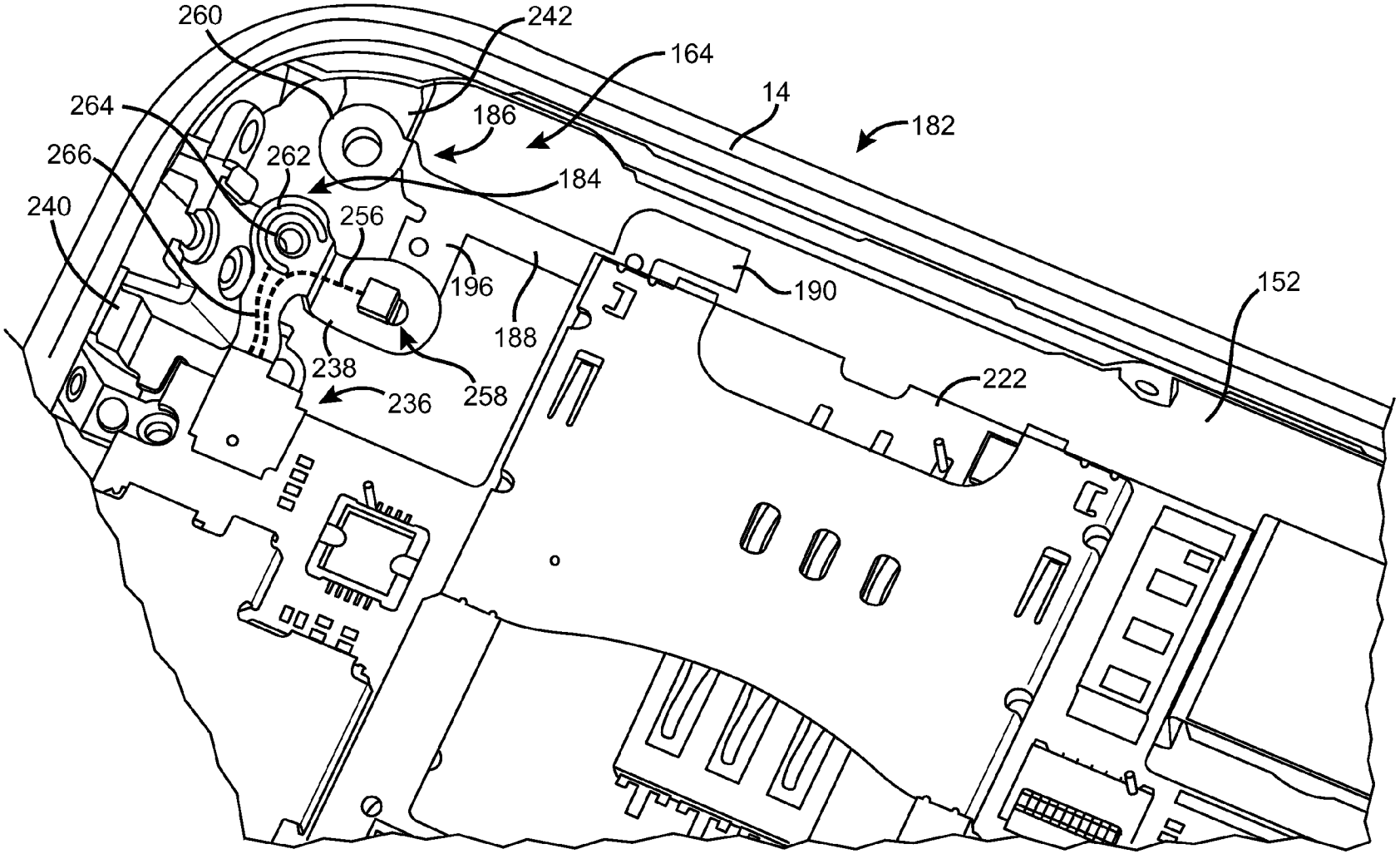
FIG. 17 is a perspective view of a portion of a handheld electronic device showing how the shape of a slot antenna structure may be defined, in part, by electrical components such as a printed circuit board and how an inverted-F antenna structure may be located adjacent to the slot in accordance with an embodiment of the present invention.

A perspective view of inverted-F antenna structure 164 mounted in device 10 is shown in FIG. 17. As shown in FIG. 17, inverted-F antenna structure 164 may have an arm 188 with a bent portion 190. Flex circuit 238 may be used to implement a microstrip transmission line having a positive signal line and a ground signal line. The flex circuit transmission line may be used to interconnect coaxial cable connector 236 to antenna structure 164, thereby creating a feed arrangement for hybrid antenna 182 of the type shown in FIG. 12.

The ground path in transmission line 238 is represented by dashed line 266. As shown in FIG. 17, ground path 266 may be connected to ground contact pad 262. When screw 248 (FIG. 15) is inserted in hole 264, the underside of the head of screw 248 may bear against contact pad 262. This forms an electrical contact between antenna ground path 266 and ringer bracket 240 and forms a ground antenna terminal for antenna 182 such as ground terminal 184 of FIG. 12.

The positive signal path in transmission line 238 is represented by dashed line 256. Positive signal path 256 may be electrically connected to inverted-F antenna conductor 196 at contact 258. Contact 258 may be, for example, a solder joint between path 256 and conductor 196. Portion 260 of inverted-F antenna structure 164 may be electrically connected to audio jack bracket 242 when screw 244 (FIG. 15) is screwed into place. Portion 260 and bracket 242 reside on the opposite side of slot 152 from ground antenna terminal 184 and serve as positive antenna feed terminal 186, as described in connection with FIG. 12.

Figure 18:
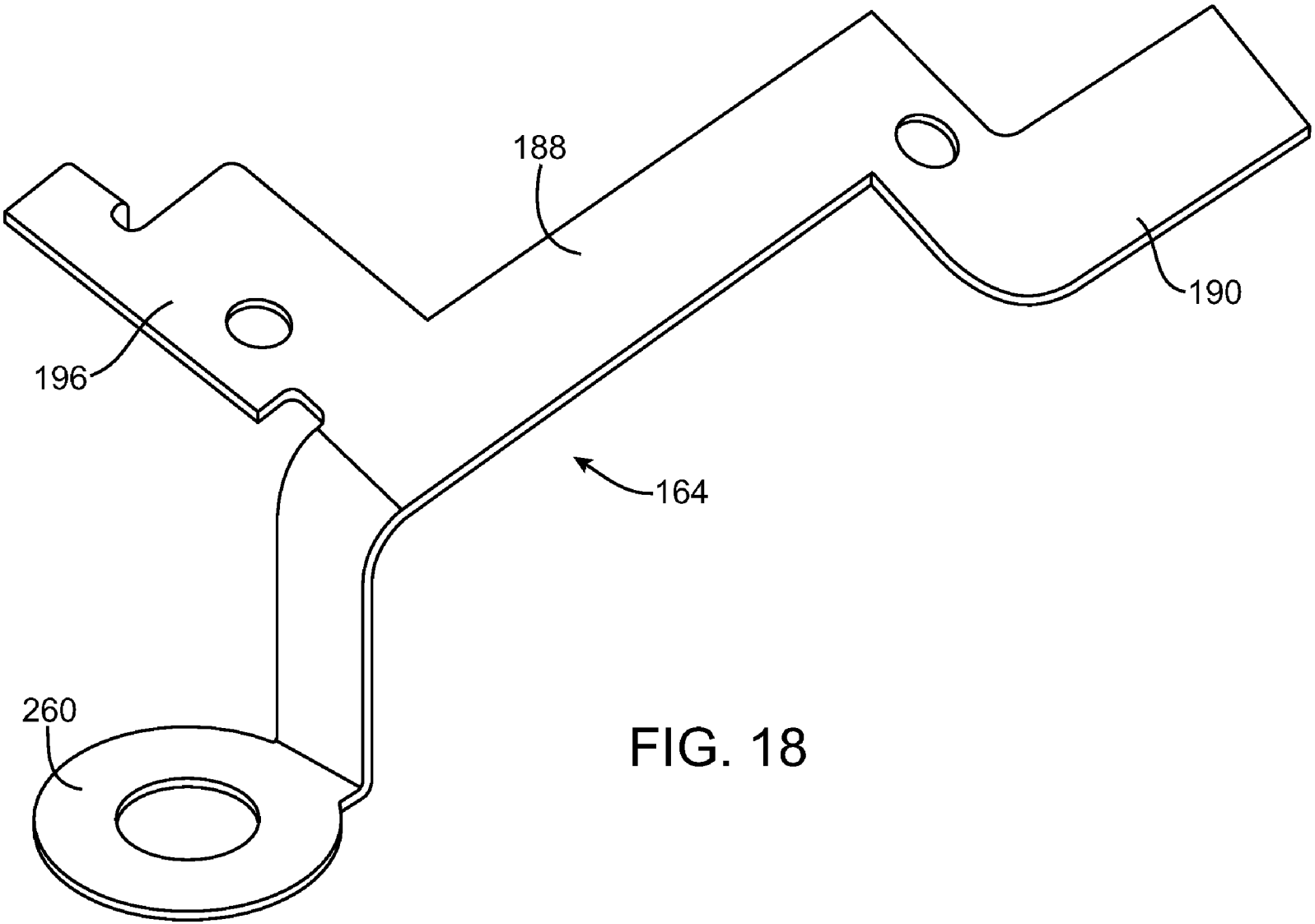
FIG. 18 is a perspective view of an illustrative antenna structure that may be used in implementing an inverted-F portion of a hybrid antenna in accordance with an embodiment of the present invention.
Figure 19:
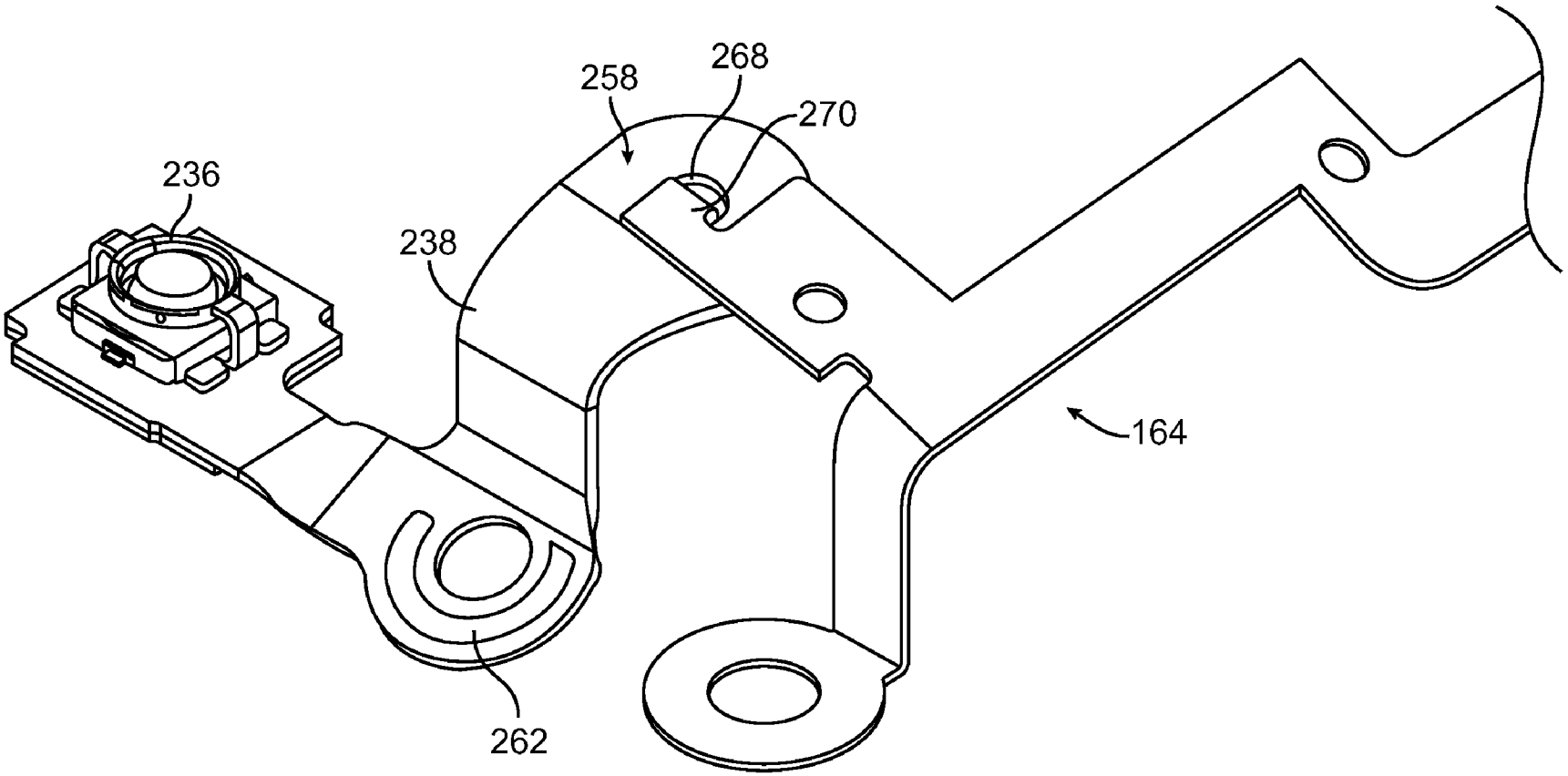
FIG. 19 is a perspective view of the inverted-F antenna structure of FIG. 18 to which an associated flex circuit transmission line structure has been electrically connected in accordance with an embodiment of the present invention.
Figure 20:
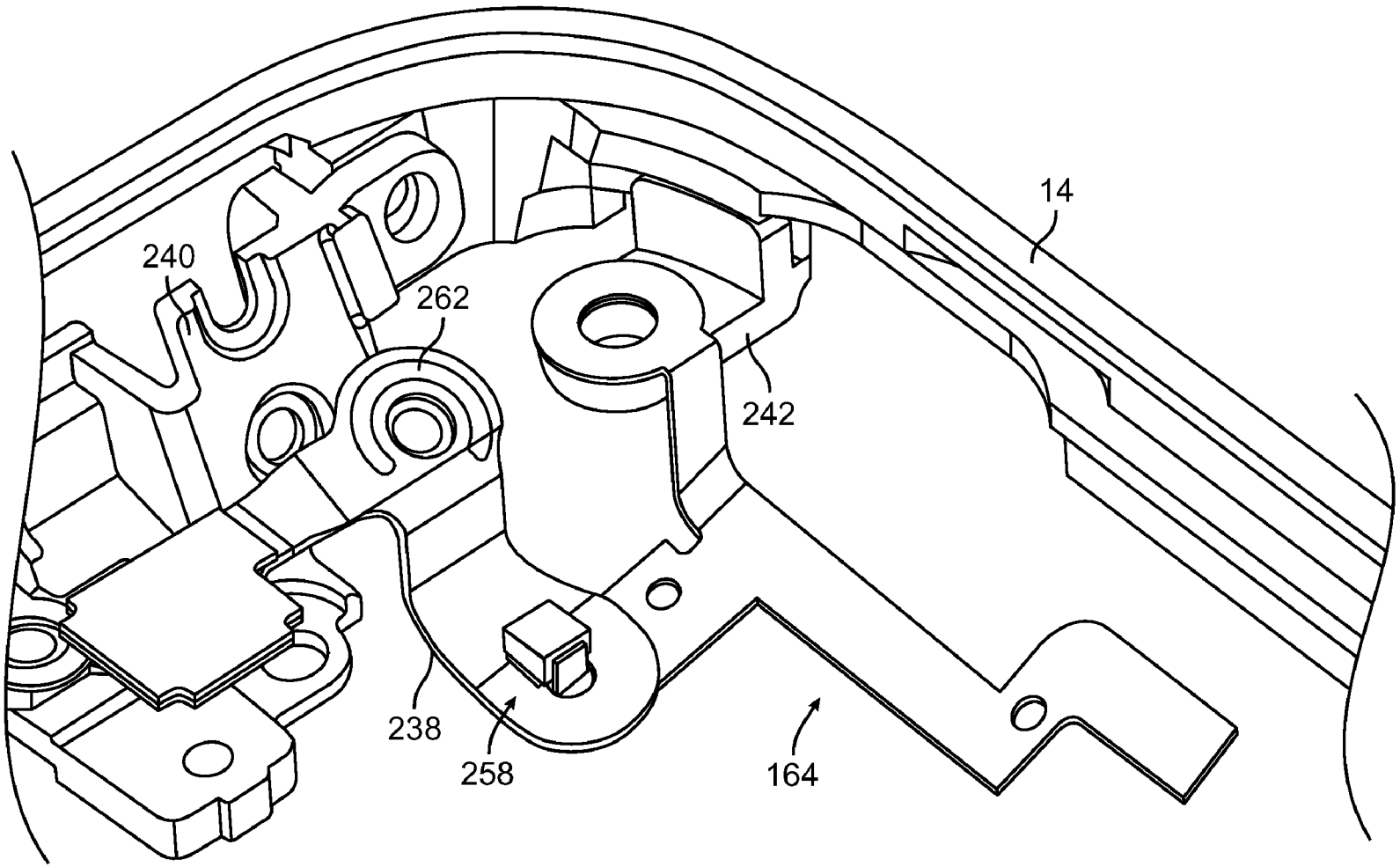
FIG. 20 is a perspective view of the inverted-F antenna structure of FIG. 19 showing how the antenna may be connected to a ringer bracket that is shorted to a conductive bezel that in turn defines at least part of the perimeter associated with the antenna slot structure in accordance with the present invention.
Figure 21:
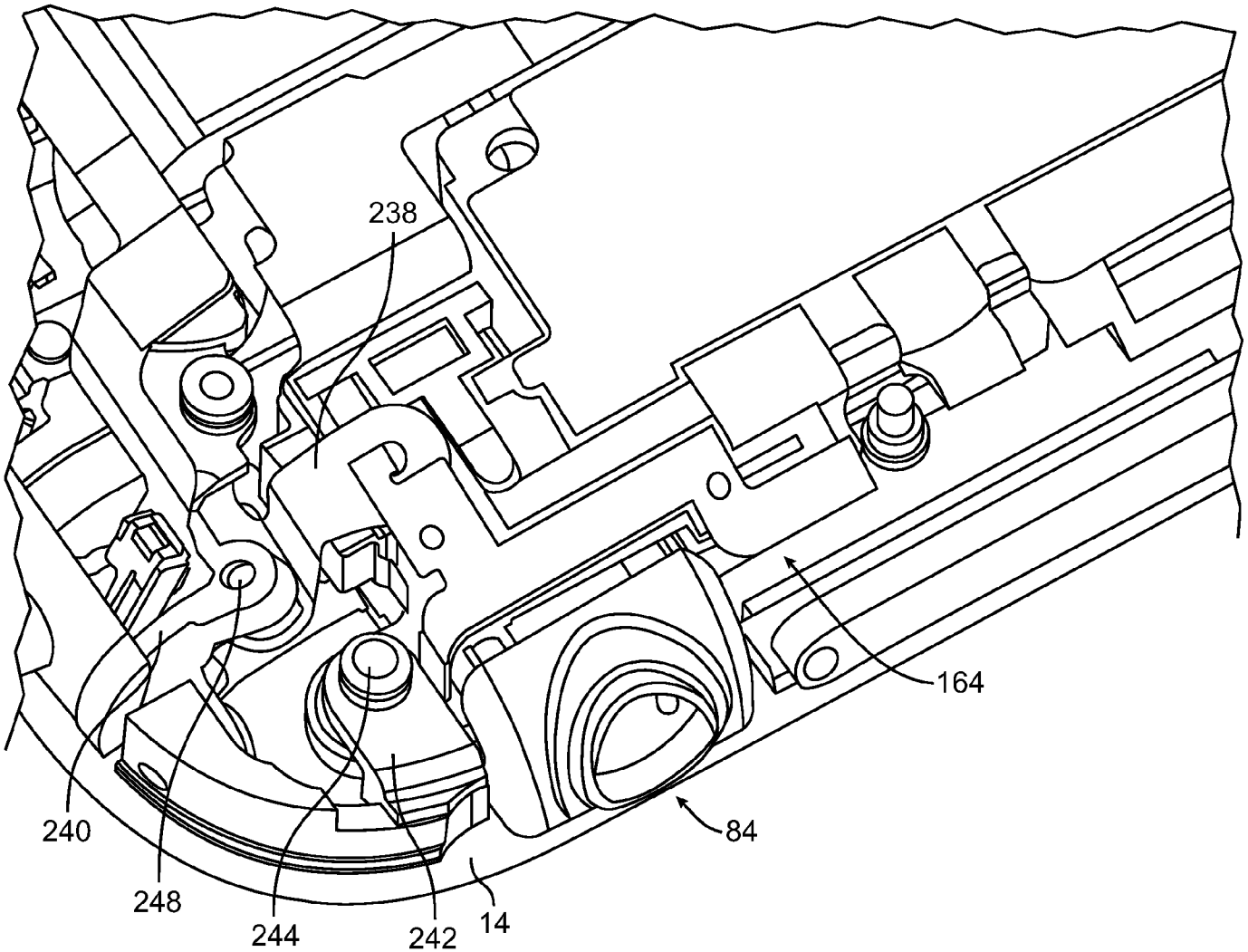
FIG. 21 is a perspective view of a portion of a handheld electronic device showing how an inverted-F antenna element may be mounted adjacent to a slot antenna structure formed from electrical components in the handheld electronic device in accordance with the present invention.

Inverted-F antenna structure 164 may be formed from any suitable conductive material such as metal (metal alloy). An illustrative shape that may be used for inverted-F antenna structure 164 is shown in the perspective view of FIG. 18. FIG. 19 presents a more detailed view of the location of solder connection 258. In FIG. 19, no solder is present, so the shape of inverted-F antenna structure 164 in the vicinity of connection 258 is not obscured. As shown in FIG. 19, connection 258 may be formed by inserting a bent tip portion 270 of inverted-F antenna structure 164 into hole 268. Solder (not shown in FIG. 19) may then be used to electrically connect the ground conductor in flex circuit 238 to inverted-F antenna element 164. FIG. 20 shows connection 258 in more detail from an inverted perspective (i.e., the general perspective of FIG. 17, but in more detail). FIG. 21 shows inverted-F antenna structure 164 mounted within a corner of device 10.

Many of the electrical components that surround slot 152 may be mounted on an assembly such as housing assembly 70 (FIG. 7). As described in connection with FIG. 15, this may leave gaps along the edge of slot 152 such as gaps 226 and 254. Gaps 226 and 254 are filled with dielectrics (e.g., air, plastic, etc.), and therefore do not form a conductive part of antenna 184. Gaps 226 may be bridged by conductive components such as conductive components mounted to tilt assembly 60 (FIG. 7). When tilt assembly 60 and housing assembly 70 are connected during the assembly process, the conductive portions of the tilt assembly may bridge gaps such as gaps 226 and 254.

Figure 22:
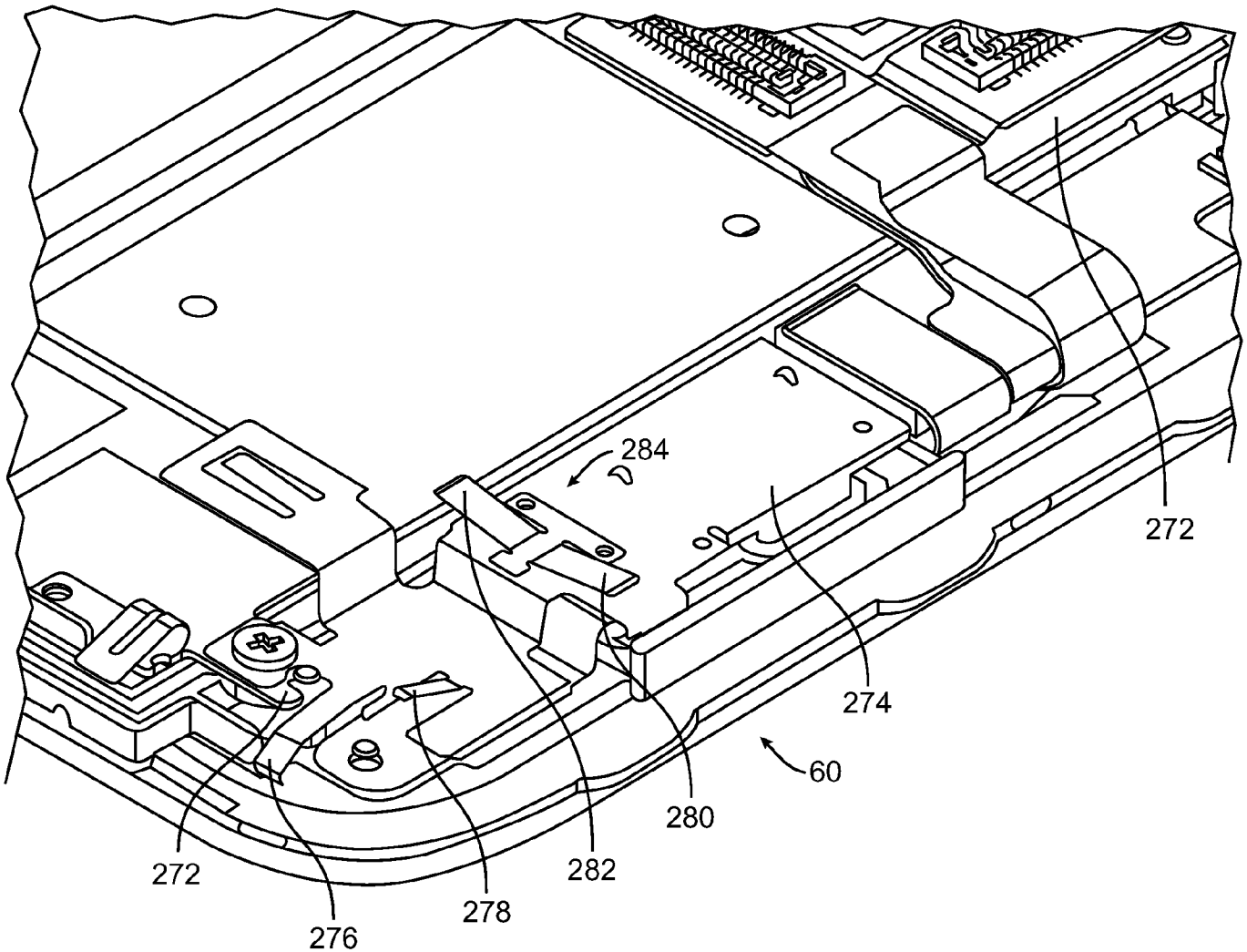
FIG. 22 is a perspective view of an illustrative upper (tilt assembly) portion of a handheld electronic device showing how the device may have electrical contact structures such as springs that may be used in constructing an electrically continuous perimeter for a slot antenna structure in accordance with the present invention.

A perspective view of an interior end portion of device 10 (tilt assembly 60) is shown in FIG. 22. As shown in FIG. 22, tilt assembly 60 may include mounting structures such as midplate 272. Midplate 272 may be formed from metal or other suitable materials. Midplate 272 may form a strengthening structure for tilt assembly 60. For example, midplate 272 may help to support the display and touch sensor and may provide support for a plastic frame and associated frame struts in tilt assembly 60. In this capacity, midplate 272 may be a relatively large rectangular member that extends from the left to the right of device 10 and that extends most of the way from the top to the bottom of device 10.

Conductive structures such as conductive bracket 274 may be mounted to tilt assembly 60. Bracket 274 may be formed of one or more pieces of metal (as an example) and may be used to bridge gaps 226 and 254 (FIG. 15). Connecting structures such as springs 276, 278, and 284 may be formed on bracket 274. In the illustrative arrangement of FIG. 22, springs such as springs 276 and 278 (spring prongs) are shown as being formed from bent portions of bracket 274 and leaf spring 284 is shown as being formed from a separate metal spring structure having flexible arms (spring prongs) 282 and 280. This is merely an example. Any suitable spring structures or other electrical connection structures may be used to form gap bridging structures if desired (e.g., structures based on conductive foam, spring-loaded pins, etc.).

During assembly, tilt assembly 60 will be mounted on top of the housing assembly structures shown in FIG. 15. In this configuration, spring 276 may form electrical contact with ringer bracket 240, spring 278 may form electrical contact with audio-jack and audio flex contact pad 232, and spring 284 may form electrical contact with SIM cage 220 at points 228 (FIG. 15). By shorting bracket 274 to the electrical components of housing assembly 70, bracket 274 can bridge gaps such as gaps 226 and 254 and thereby complete the perimeter of slot 154. This type of slot-completing arrangement may be used in a hybrid antenna or any other antenna containing an antenna slot.

Figure 23:
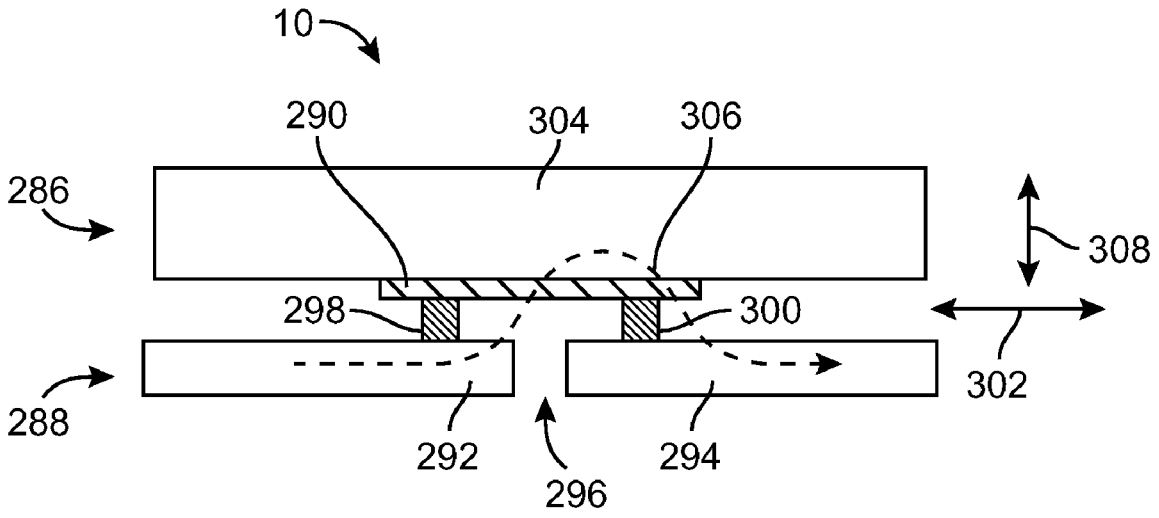
FIG. 23 is a schematic cross-sectional end view of a handheld electronic device having a tilt assembly and a housing assembly showing how an electrical path associated with a slot antenna structure may pass through clips or other conductive structures and may pass through conductive elements on both the tilt assembly and the housing assembly in accordance with an embodiment of the present invention.

The use of separate portions of device 10 such as tilt assembly 60 and housing assembly 70 in forming antenna slot 152 is illustrated in the side view of FIG. 23. As shown in FIG. 23, device 10 may have a first portion 286 and a second portion 288. First portion 286 may have one or more housing structures and associated components, represented schematically as structure 304. Second portion 288 may also have one or more housing structures and associated components, represented schematically as structures 292 and 294. As described in connection with antenna slot 152 of FIG. 14, components 292 and 294 may help define the edge of antenna slot 152 (i.e., a slot that lies in a plane perpendicular to the page of FIG. 23 and parallel to horizontal dimension 302), but may have one or more dielectric-filled gaps such as gap 296.

To bridge these gaps in the conductive structures of second portion 288 and to ensure that the perimeter of slot 152 is properly closed, conductive bridging structures such as bridging structure 290 may be provided. Bridging structure 290 may be, for example, a bracket that has been mounted to structures in first portion 286 (e.g., member 304). Conductive connection structures such as structures 298 and 300 may be provided on second portion 288 (or, if desired, on first portion 286 or both first and second portions 288 and 286). Conductive connection structures 298 and 300 may be formed from springs, spring-loaded pins, conductive foam, or any other suitable conductive structures. When assembled together in device 10, conductive connection structures 298 and 300 electrically connect conductive members 292 and 294 to bridging structure 290, so that conductive path 306 is formed. Path 306 bridges gap 296 by allowing radio-frequency signals to flow out of the primary plane of the slot in vertical (z) dimension 308. This completes the antenna slot perimeter, as discussed in connection with gaps 226 and 254 of FIG. 15. Any suitable number of bridging conductors may be used in device 10 to bridge any suitable number of antenna slot gaps. The illustrative arrangement of FIG. 23 in which a single gap is bridged is merely illustrative. Moreover, bridging structures may be formed on any suitable housing portions. Situations in which slot gaps are formed in the conductive structures associated with a lower portion of a housing and in which the bridging structures such as a bridging conductive bracket are formed on an upper housing portion have merely been presented as an example.

Figure 24:
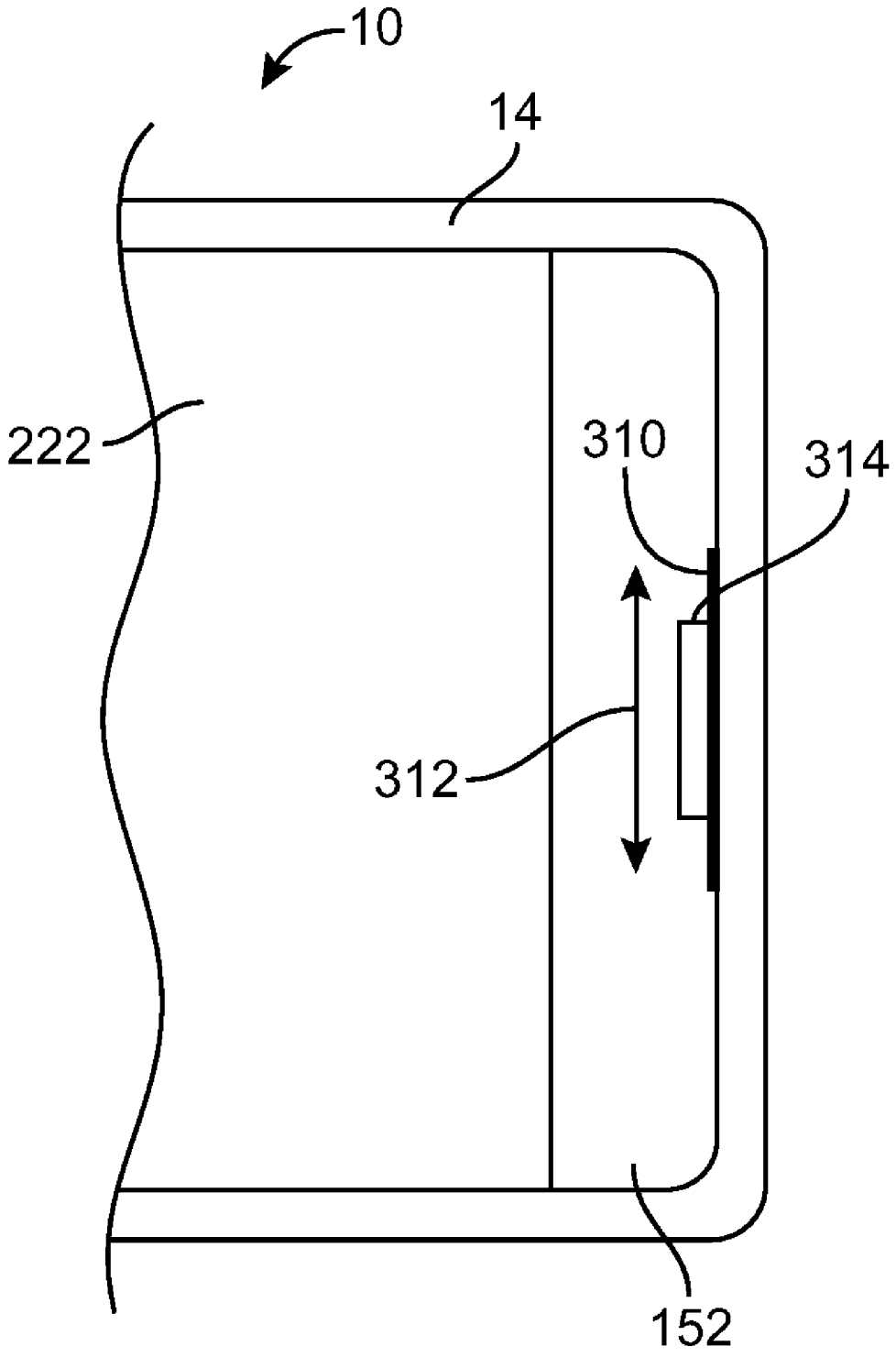
FIG. 24 is a schematic top view of an end of a handheld electronic device having a bezel with a conductive slot-size trim piece such as a conductive foam structure that may be used to make size adjustments to a slot in a slot antenna in accordance with an embodiment of the present invention.

As shown in the top view of an end of device 10 in FIG. 24, bezel 14 may have a flattened inner portion such as flattened surface 310. Flattened surface 310 may form a plane that lies perpendicular to the page of FIG. 24 and which runs along longitudinal dimension (axis) 312 of slot 152. Flattened surfaces or other such surfaces along other portions of the inner perimeter of slot 152 may also be formed.

During manufacturing operations, it may be desirable to tune the resonance of antenna slot 152 (e.g., to adjust resonant frequency f1 of FIG. 13). Tuning may be performed using a removable conductive structure that is inserted into slot 152 (e.g., along the inner perimeter of slot 152) during manufacturing. As an example, one or more pieces of conductive foam such as conductive foam 314 may be attached to flattened surface 310 (e.g., by adhesive). Conductive foam 314 serves as a conductive resonant frequency trim member for the antenna slot that tunes the resonant frequency of the slot. At resonant frequency f1, the slot perimeter is approximately equal to one wavelength. Accordingly, the resonant frequency f1 of slot 152 and therefore the slot resonance of an antenna such as hybrid antenna 182 may be tuned by adjusting the amount of conductive foam or other conductive tuning structures that are inserted into the slot. When the slot perimeter is enlarged, the frequency f1 will tend to shift to lower frequencies. When the slot perimeter is reduced, the frequency f1 will tend to shift to higher frequencies. Slot perimeter adjustments may be made automatically (e.g., using computerized assembly equipment) or manually (e.g., by manually attaching a desired amount of conductive foam 314 on flattened portion 310 if desired.

The foregoing is merely illustrative of the principles of this invention and various modifications can be made by those skilled in the art without departing from the scope and spirit of the invention.

What is claimed is:

1. An antenna in a portable electronic device having first and second housing portions, comprising:

conductive structures in the first housing portion that define an antenna slot having a perimeter with at least one gap; and a conductive bridging structure mounted to the second housing portion that bridges the gap and completes at least a portion of the perimeter of the antenna slot when the first and second housing portions are connected to form the portable electronic device.

2. The antenna defined in claim 1 further comprising an inverted-F antenna structure mounted adjacent to the antenna slot.

3. The antenna defined in claim 2 wherein the antenna slot handles global positioning system radio-frequency signals, wherein the inverted-F antenna structure handles radio-frequency signals in a 2.4 GHz communications band, and wherein the conductive structures comprise a printed circuit board.

4. The antenna defined in claim 2 wherein the antenna slot handles global positioning system radio-frequency signals, wherein the inverted-F antenna structure handles Bluetooth® radio-frequency signals in a 2.4 GHz communications band, and wherein the conductive structures comprise a printed circuit board.

5. The antenna defined in claim 2 wherein the antenna slot handles global positioning system radio-frequency signals, wherein the inverted-F antenna structure handles IEEE 802.11 radio-frequency signals in a 2.4 GHz communications band, and wherein the conductive structures comprise a printed circuit board.

6. The antenna defined in claim 1 wherein the conductive structures comprise at least one structure selected from the group consisting of: a camera, a flex circuit, a conductive bezel, and a metal bracket.

7. The antenna defined in claim 1 wherein the first housing portion comprises a tilt assembly containing a display and wherein the second housing portion comprises a housing assembly containing a plastic housing.

8. A portable electronic device, comprising:

a first assembly containing conductive structures that define an antenna slot, wherein the antenna slot has an inner perimeter with at least one gap, wherein the gap lies along the inner perimeter of the antenna slot; and a second assembly that includes a conductive bridging structure that bridges the gap and completes at least a portion of the inner perimeter of the antenna slot when the first and second assemblies are connected to each other to form the portable electronic device.

9. The portable electronic device defined in claim 8 further comprising a hybrid antenna that includes the antenna slot and an inverted-F antenna structure mounted adjacent to the antenna slot.

10. The portable electronic device defined in claim 8 wherein the first assembly comprises a housing assembly that includes a plastic housing.

11. The portable electronic device defined in claim 10 wherein the second assembly comprises a tilt assembly that includes a display.

12. The portable electronic device defined in claim 11 further comprising an inverted-F antenna structure mounted adjacent to the antenna slot.

13. The portable electronic device defined in claim 8 further comprising a hybrid antenna that includes the antenna slot and an inverted-F antenna structure mounted adjacent to the antenna slot, wherein the first assembly comprises a bezel that forms part of the hybrid antenna.

14. The portable electronic device defined in claim 13 wherein the first assembly has first and second spring prongs located on opposite sides of the gap and wherein the conductive bridging structure comprises a conductive member on the second assembly that electrically connects the first and second spring prongs when the first and second assemblies are connected to each other.

15. The portable electronic device defined in claim 14 further comprising a leaf spring that is electrically connected to the conductive structures, wherein the first spring prong forms part of the leaf spring.

16. The portable electronic device defined in claim 8 further comprising:

a switch; and a bracket with which the switch is mounted to the first assembly, wherein the bracket forms one of the conductive structures, and wherein the conductive bridging structure electrically connects the bracket to another of the conductive structures when bridging the gap.

17. The portable electronic device defined in claim 8 further comprising an additional gap along the inner perimeter of the antenna slot, wherein the conductive bridging structure bridges both the gap and the additional gap.

18. The portable electronic device defined in claim 17 further comprising first, second, and third springs, wherein the first and second springs are located on opposite sides of the gap and form a first set of electrical contacts between the conductive structures and the conductive bridging structure and wherein the second and third springs are located on opposite sides of the additional gap and form a second set of electrical contacts between the conductive structures and the conductive bridging structure.

19. The portable electronic device defined in claim 18 further comprising an inverted-F antenna structure, wherein the antenna slot and the inverted-F antenna structure form a hybrid antenna that covers at least a first band of communications frequencies associated with the antenna slot and a second band of communications frequencies associated with the inverted-F antenna structure, and wherein the first and second bands are not harmonically related.

20. The portable electronic device defined in claim 19 wherein the first band includes global positioning system signal frequencies and wherein the second band comprises a 2.4 GHz band, and wherein the conductive structures comprise at least one electrical component.

21. The portable electronic device defined in claim 20 wherein the electrical component comprises a camera.

22. The portable electronic device defined in claim 8 further comprising an inverted-F antenna structure, wherein the antenna slot and the inverted-F antenna structure form a hybrid antenna that covers at least a first band of communications frequencies associated with the antenna slot and a second band of communications frequencies associated with the inverted-F antenna structure, and wherein the first and second bands are not harmonically related.

23. The portable electronic device defined in claim 22 wherein the first band includes global positioning system signal frequencies and wherein the second band comprises a 2.4 GHz band, and wherein the conductive structures comprise a conductive bezel.

24. The portable electronic device defined in claim 22 wherein the first band includes global positioning system signal frequencies and wherein the second band comprises a 2.4 GHz band, and wherein the conductive structures comprise a flex circuit, a printed circuit board, a camera, and a conductive bezel.

25. The portable electronic device defined in claim 22 wherein the conductive structures comprise conductive foam.

26. The portable electronic device defined in claim 8 further comprising:

an inverted-F antenna structure; and a flex circuit transmission line having a positive signal conductor and a ground signal conductor, wherein the antenna slot and the inverted-F antenna structure form a multiband hybrid antenna for the portable electronic device, and wherein the inverted-F antenna structure comprises a metal structure that is electrically connected to the positive signal conductor and wherein the ground signal conductor is electrically connected to the conductive structures that form the antenna slot.

27. The portable electronic device defined in claim 26 further comprising a solder joint that electrically connects the positive signal conductor to the inverted-F antenna structure.

28. The portable electronic device defined in claim 27 wherein the conductive structures include a switch mounting bracket, the portable electronic device further comprising a screw that electrically connects the ground signal conductor to the switch mounting bracket.

* * * * *